US010052260B2

(12) United States Patent
Omura et al.

(10) Patent No.: US 10,052,260 B2
(45) **Date of Patent: *Aug. 21, 2018**

(54) MEDICINE DISPENSING APPARATUS

(75) Inventors: Yoshihito Omura, Tokyo (JP); Syunji Ohgaya, Tokyo (JP)

(73) Assignee: TOSHO, INC., Tokyo (JP)

( * ) Notice: Subject to any disclaimer, the term of this patent is extended or adjusted under 35 U.S.C. 154(b) by 1172 days.

This patent is subject to a terminal disclaimer.

(21) Appl. No.: 14/349,812

(22) PCT Filed: Jul. 3, 2012

(86) PCT No.: PCT/JP2012/066997

§ 371 (c)(1),
(2), (4) Date: Apr. 26, 2014

(87) PCT Pub. No.: WO2013/051313

PCT Pub. Date: Apr. 11, 2013

(65) Prior Publication Data

US 2014/0245697 A1 Sep. 4, 2014

(30) Foreign Application Priority Data

Oct. 5, 2011 (JP) ..... 2011-221098
Oct. 17, 2011 (JP) ..... 2011-228371

(51) Int. Cl.
*A61J 3/00* (2006.01)
*B65B 1/06* (2006.01)
(Continued)

(52) U.S. Cl.
CPC ..... *A61J 3/00* (2013.01); *B65B 1/06* (2013.01); *G07F 11/10* (2013.01); *G07F 17/0092* (2013.01)

(58) Field of Classification Search
CPC .... A61J 3/00; B65B 1/06; G07F 11/00; G07F 17/0092; G07F 11/10
(Continued)

(56) References Cited

U.S. PATENT DOCUMENTS 8,925,434 B2 * 1/2015 Omura ..... A61J 7/0007 225/93
9,186,301 B2 * 11/2015 Omura ..... B65D 83/04
(Continued)

FOREIGN PATENT DOCUMENTS

JP 2001-087353 4/2001
JP 2005-192702 7/2005
(Continued)

OTHER PUBLICATIONS

European Search Report dated Apr. 17, 2015, 6 pages.
International Search Report, dated Oct. 16, 2012 (Oct. 16, 2012).

*Primary Examiner* — Michael Collins
(74) *Attorney, Agent, or Firm* — Rankin, Hill & Clark LLP

(57) ABSTRACT

A medicine dispensing apparatus in which a medicine guide assembly is constituted from first and second split guide members and in which substantially no dust is generated through rubbing between the first and second split guide members. The gap between a pair of guide paths of a pair of linear guide mechanisms provided for a pair of medicine feeder storing units, that is, paths along which movable slide portions slide on fixed guide portions, becomes wider in a drawing direction in which the medicine feeder storing units are drawn out.

18 Claims, 23 Drawing Sheets

(51) Int. Cl.
*G07F 11/10* (2006.01)
*G07F 17/00* (2006.01)

(58) Field of Classification Search
USPC ..... 700/231–244; 221/92, 123–133
See application file for complete search history.

(56) References Cited

U.S. PATENT DOCUMENTS

| | | | | |
|---|---|---|---|---|
| 2004/0182878 | A1 | 9/2004 | Ho | |
| 2005/0096787 | A1* | 5/2005 | Kim | B65B 5/103 700/242 |
| 2007/0150092 | A1 | 6/2007 | Ohmura et al. | |
| 2009/0152291 | A1 | 6/2009 | Ohmura et al. | |
| 2009/0266029 | A1 | 10/2009 | Kim | |
| 2012/0324829 | A1 | 12/2012 | Omura et al. | |

FOREIGN PATENT DOCUMENTS

| | | |
|---|---|---|
| JP | 2006-109860 | 4/2006 |
| JP | 2007-209600 | 8/2007 |
| JP | 2009-261932 | 11/2009 |
| JP | 2011-182889 | 9/2011 |
| JP | 2011-182890 | 9/2011 |
| WO | 2011/108129 | 9/2011 |

* cited by examiner

MEDICINE DISPENSING APPARATUS

TECHNICAL FIELD

The present invention relates to a medicine dispensing apparatus configured to store various types of medicines (including tablets such as pills and capsules) and separately pack the medicines according to input based on a prescription or a pharmaceutical indication to automatically discharge the medicines.

BACKGROUND ART

The structure etc. of a medicine dispensing apparatus according to the related art will be described with reference to FIG. 12. FIG. 12A is a perspective view illustrating the appearance of a medicine dispensing apparatus 10 according to the related art as seen from the left front. FIG. 12B is a schematic view illustrating the internal structure of the medicine dispensing apparatus 10. FIG. 12C is a perspective view illustrating the appearance of the medicine dispensing apparatus 10 as seen from the left front. FIG. 12D is a left side view of another medicine dispensing apparatus 20 according to the related art including a medicine individual distributing device, that is, a manual medicine dispenser (21, 22).

The medicine dispensing apparatus 10 illustrated in FIGS. 12A to 12C are not provided with a manual medicine dispenser. This type of medicine dispensing apparatus is disclosed in JP2005-192702A (Patent Document 1) and JP2006-109860A (Patent Document 2), for example. The medicine dispensing apparatus 20 illustrated in FIG. 12D is obtained by integrating the medicine dispensing apparatus 10 with the manual medicine dispenser (21, 22). This type of medicine dispensing apparatus is disclosed in JP2007-209600A (Patent Document 3), for example.

The medicine dispensing apparatus 10 with no manual medicine dispenser includes a plurality of medicine feeders 13, a medicine collecting structure (14, 15), a packing device 17, and a controller 18 (control device). The plurality of medicine feeders 13 store various types of medicines 1 such as tablets such as pills and capsules separately according to their types. The medicine collecting structure (14, 15) collects the plurality of medicines 1 discharged from the medicine feeders 13. The packing device 17 packs the plurality of medicines 1 received from the medicine collecting structure (14, 15). The controller 18 (control device) constituted from a microprocessor system etc. outputs a control command to the plurality of medicine feeders 13 and the packing device 17. The controller 18 receives prescription data, pharmaceutical indication data, or the like and provides a control command to a medicine feeder 13 storing the medicines indicated by the received data to cause the medicine feeder 13 to discharge a necessary number of medicines 1. The medicines 1 discharged from the medicine feeder 13 are collected by the medicine collecting structure (14, 15), and fed into a medicine entry port 16 (collected medicine entry port) located downward or downstream. The controller 18 provides a control command to the packing device 17 to cause the packing device 17 to separately pack the medicines fed into the medicine entry port 16 by the dosing unit or the administering unit. The packing device 17 charges the medicines separated by the dosing unit or the administering unit into pockets separately formed between two packing strips 2 (dispensing paper), and thereafter tightly seals an opening portion of the pockets.

More particularly, a medicine storage 11 is provided in the upper space in a housing 10A of the medicine dispensing apparatus 10, and the packing device 17 is provided in the lower space in the housing 10A. Medicine guide assemblies 14 and a medicine collecting assembly 15 serving as the medicine collecting structure are disposed in the housing 10A between the medicine storage 11 and the packing device 17. The medicine storage 11 includes a plurality of individually slidable medicine feeder storing units 12 (medicine storage spaces) disposed side by side with each other. The medicine feeder storing units 12 each include a medicine feeder storing case 12A [FIG. 12C], and several to several tens of removable medicine feeders 13 stored inside the medicine feeder storing case 12A and arranged vertically and horizontally.

The medicine feeders 13 each include a medicine cassette and a base portion. The medicine cassette houses a large number of medicines 1 to discharge the medicines. The base portion removably supports the medicine cassette, and performs driving operation for discharging the medicines from the medicine cassette. The medicine feeders 13 are each configured to discharge a number of medicines 1, the number being specified by the controller 18, to feed the medicines 1 into the medicine guide assembly 14.

The medicine guide assemblies 14 known in the art each include a guide tube such as a duct disposed vertically, and a plurality of extended tubes configured to communicate with respective discharge ports of the plurality of medicine feeders 13. The medicine guide assembly 14 is provided for each medicine feeder storing unit 12, and drawn out of the housing 10A together with the medicine feeder storing unit 12. In FIG. 12B, in order to simplify the illustration, a common medicine guide assembly 14 is depicted to be provided for two medicine feeder storing units 12. In FIG. 12C, the medicine guide assemblies 14 are not illustrated.

The medicine feeder storing units 12 are each configured such that the medicine guide assembly 14 and the medicine feeders 13 can be drawn forward together with the medicine feeder storing case 12A by horizontally sliding the medicine feeder storing unit 12 forward of the housing 10A.

The medicine collecting assembly 15 is constituted from a relatively large hopper-shaped member or funnel-shaped member. The medicine collecting assembly 15 is installed in a space in the housing 10A below the medicine storage 11 to be positioned above the packing device 17. The upper opening of the medicine collecting assembly 15 opens to be wide enough to face the respective lower ends of all the medicine guide assemblies 14. The lower opening of the medicine collecting assembly 15 is tapered toward the medicine entry port 16 of the packing device 17. As a result, all the medicines 1 guided by any medicine guide assembly 14 are collected by the lower opening of the medicine collecting assembly 15 to be fed into the packing device 17. Thus, the medicine collecting assembly 15 forms a common guide passage leading from all the medicine guide assemblies 14 to the packing device 17.

FIG. 12D illustrates a schematic configuration of the medicine dispensing apparatus 20 with a manual medicine dispenser described in JP2007-209600A (Patent Document 3). As discussed above, the medicine dispensing apparatus 20 is obtained by integrating the medicine dispensing apparatus 10 with the manual medicine dispenser (21, 22).

Next, the structure of a medicine dispensing apparatus 30 described in Japanese Patent Application No. 2010-049924 filed by the applicant will be described with reference to FIG. 13. In the medicine dispensing apparatus 30, not only a manual medicine dispenser (21, 22) but also a temporary storage device 31 is integrated in the housing. FIG. 13A is a perspective view illustrating the appearance of the medicine dispensing apparatus 30 as seen from the left front with all the medicine feeder storing units 12 and the temporary storage device 31 pushed into the housing 10A. FIG. 13B is a schematic view illustrating the internal structure of the medicine dispensing apparatus 30. FIG. 13C is a perspective view illustrating the appearance of the medicine dispensing apparatus 30 as seen from the left front with one of the medicine feeder storing units 12 and the temporary storage device 31 drawn out of the housing.

The temporary storage device 31 is provided as a middle layer between the medicine guide assemblies 14 and the manual medicine dispenser (21, 22) on the upper side and the medicine collecting assembly 15 on the lower side. The temporary storage device 31 temporarily retains the medicines (tablets) 1 discharged from the medicine feeders 13 and dropped as guided by the medicine guide assemblies 14, and releases the medicines 1 at an appropriate timing to drop the medicines 1 into the medicine collecting assembly 15. Temporarily storing the medicines resolves the difference in discharge timing among the medicine feeders 13 and hence variations in fall start timing, and resolves the difference in fall path length among the medicine guide assemblies 14 and hence variations in timing when themedicines (tablets) 1 are collected due to variations in fall duration. Consequently, the medicines 1 corresponding to one pack are collectively dropped at a time into the medicine collecting assembly 15, thereby reducing the time for which the packing device 17 waits for input and contributing to speeding up of medicine dispensing.

The temporary storage device 31 includes, as its main members, cylindrical bodies having a hollow space directed in the vertical direction, and open-close members operable to open and close the hollow spaces. In an example of the temporary storage device 31, the cylindrical bodies and the open-close members are planarly disposed in a matrix to correspond to the medicine guide assemblies 14 planarly disposed in a matrix. In another example, one temporary storage structure 32 is disposed for each medicine guide assembly 14. In the temporary storage device 31 of the medicine dispensing apparatus 30 illustrated in the drawing, the latter temporary storage structures 32 are arranged in row. In order to open and close the open-close mechanisms for the plurality of temporary storage structures 32 at the same time, the temporary storage device 31 is also provided with a simultaneous driving mechanism 33 coupled to the temporary storage structures 32 from one end side to drive operation of the open-close mechanisms.

In the medicine dispensing apparatuses 10, 20, and 30 discussed above, the medicine guide assembly 14 is integrated in each medicine feeder storing unit 12. Therefore, the medicine guide assembly 14 is cleaned by first drawing the medicine feeder storing unit 12 forward out of the medicine storage 11 or the housing to expose the upper and lower ends of the medicine guide assembly 14, and inserting a cleaning tool into a hollow space from the upper and lower openings to wipe medicine falling path surrounding surfaces inside the medicine guide assembly 14. Such cleaning work forces a worker to work in an unnatural posture, which not only puts a burden on the worker but also results in a low efficiency. Thus, it has been desired to provide a medicine dispensing apparatus that facilitates cleaning of the inner surface of the medicine guide assembly 14.

Then, in order to address such a demand, there has been developed a medicine dispensing apparatus improved such that the medicine guide assembly 14 is vertically split and the medicine falling path surrounding surfaces inside the medicine guide assembly are exposed as the medicine feeder storing unit 12 is drawn out (see Patent Document 6, for example). FIG. 14 illustrates the configuration of such an improved medicine dispensing apparatus 40. FIG. 14A is a plan view of a plurality of medicine guide assemblies 14 etc. with all the medicine feeder storing units 12 pushed into the medicine storage 11. FIG. 14B is a plan view of the medicine guide assemblies 14 etc. with some of the medicine feeder storing units 12 drawn forward out of the medicine storage 11. FIG. 15A is a perspective view of the medicine guide assembly 14 as seen from the right and obliquely above. FIG. 15B is a perspective view of a second split guide member 14B of the medicine guide assembly 14 as seen from the left and obliquely above.

In the medicine dispensing apparatus 40 illustrated in FIG. 14, the medicine guide assemblies 14 are each constituted from a first split guide member 14A and the second split guide member 14B which are vertically split. The first split guide member 14A is mounted to the side surface of one of a pair of adjacent medicine feeder storing units 12. The second split guide member 14B is mounted to the side surface of the other of the pair of adjacent medicine feeder storing units 12.

RELATED ART DOCUMENTS

Patent Documents

Patent Document 1: JP2005-192702A
Patent Document 2: JP2006-109860A
Patent Document 3: JP2007-209600A
Patent Document 4: JP2001-087353A
Patent Document 5: JP2011-182889A
Patent Document 6: JP2011-182890A

SUMMARY OF INVENTION

Technical Problem

If the medicine guide assembly 14 is vertically split, the gap between the mating surfaces of the first split guide member 14A and the second split guide member 14B is allowed to a certain degree if the medicines to be treated are relatively large. If the medicines are relatively small, however, the gap may not be very large. Therefore, in such a case, the first split guide member 14A and the second split guide member 14B of the medicine guide assembly 14 are brought into close contact with each other, or into abutment with each other in a substantially closely contacting state, such that there is not a gap that is larger than necessary between the mating surfaces of the first split guide member 14A and the second split guide member 14B.

When the first split guide member 14A and the second split guide member 14B of the medicine guide assembly 14 are separately drawn out with the first split guide member 14A and the second split guide member 14B in abutment with each other, the first split guide member 14A and the second split guide member 14B are rubbed against each other. Therefore, abrasive dust may be generated from the contacting surfaces of the first split guide member 14A and the second split guide member 14B. If the medicine guide assembly 14 is made from stainless steel or the like, such abrasive dust is non-poisonous, generated only in a very small amount, and thus practically harmless. However, abrasive dust provides an uncomfortable feeling once caught in the eyes of a viewer, and therefore it is best not to generate abrasive dust.

Thus, the medicine guide assembly 14 is vertically split into the first split guide member 14A and the second split guide member 14B, the first split guide member 14A is mounted to the side surface of one of a pair of adjacent medicine feeder storing units 12, and the second split guide member 14B is mounted to the side surface of the other of the pair of adjacent medicine feeder storing units 12. Also in this case, however, it is a basic technical issue to provide a medicine dispensing apparatus that generates substantially no abrasive dust.

In the medicine dispensing apparatus 30 according to the application filed by the applicant as illustrated in FIG. 13, focusing on the temporary storage structures 32, they are separated among the columns. However, all the temporary storage structures 32 are coupled to the identical simultaneous driving mechanism 33, and thus are installed differently from the medicine feeder storing units 12. Thus, in the medicine dispensing apparatus 30 (see FIG. 13C), the temporary storage device 31, which is located in the middle of the medicine falling path, is configured to be drawn forward to facilitate easy cleaning work of the surfaces surrounding the medicine falling path on the premise that the entirety of the temporary storage device 31 is integral. The temporary storage structures 32 each having a surface surrounding the medicine falling path are disposed on the closer side, and the simultaneous driving mechanism 33 having no surface surrounding the medicine falling path is disposed on the farther side.

In the improvement illustrated in FIG. 13C, however, the plurality of temporary storage structures 32 are arranged in parallel with each other, and the surfaces surrounding the medicine falling path are distributed in a plane. Therefore, the worker is forced to take a bent posture in cleaning the middle portion and the farther portion of the temporary storage device 31. Inaddition, it is also conceivable that foreign substances unintentionally stirred up may adhere again to an already cleaned portion. This makes the cleaning work difficult and inefficient, and thus a further improvement has been desired.

Then, in order to address such a demand, the applicant provided the medicine dispensing apparatus 30 in FIG. 13, in which transmission mechanisms are provided at the coupling portion between the simultaneous driving mechanism 33 and the temporary storage structures 32 to releasably establish engagement therebetween, the simultaneous driving mechanism 33 is disposed on the farther side, and the temporary storage structures 32 are disposed side by side in the left-right direction on the closer side to be drawn out forward one by one. In addition, as in the structure illustrated in FIG. 14, the medicine guide assembly 14 is vertically split into the first split guide member 14A and the second split guide member 14B on the left and the right. Then, the temporary storage structures 32 are each attached to the lower end portion of one of the first split guide member 14A and the second split guide member 14B of the medicine guide assembly 14. In addition, the temporary storage structures 32 are each split into the first split storage member and the second split storage member on the left and the right, the first split storage member is disposed at the lower end portion of the first split guide member 14A of the medicine guide assembly 14, and the second split storage member is disposed at the lower end portion of the second split guide member 14B of the medicine guide assembly 14. In the former structure, there is a likelihood that the tablet will be dropped even if the temporary storage structure is drawn out with the medicines being retained therein. Thus, high safety can be accomplished. In the latter structure, meanwhile, even the temporary storage structures can be cleaned in a confronting manner, which advantageously provides high workability. It has turned out that the two structures have advantages and disadvantages and have room for improvement, and therefore it is desired to develop and provide a device that has the advantages of the two structures.

Thus, it is a further technical issue to provide a medicine dispensing apparatus in which temporarily stored tablets can be prevented from undesirably falling down even while the temporary storage structure is drawn out together with the split guide members, and in which the temporary storage structure can be cleaned with a worker facing the temporary storage structure after the temporary storage structure is drawn out.

An object of the present invention is to provide a medicine dispensing apparatus in which a medicine guide assembly is constituted from first and second split guide members and in which substantially no dust is generated through rubbing between the first and second split guide members.

Another additional object of the present invention is to provide a medicine dispensing apparatus in which temporarily stored tablets can be prevented from undesirably falling down even while a temporary storage structure is drawn out in accompaniment with medicine guide members, and in which the temporary storage structure can be cleaned in a confronting manner after the temporary storage structure is drawn out.

Solution to Problem

The medicine dispensing apparatus according to the present invention has been devised to address the foregoing issues, and includes a housing, a plurality of medicine feeder storing units, a plurality of linear guide mechanisms, a plurality of medicine guide assemblies, a medicine collecting assembly, and a packing device. The plurality of medicine feeder storing units are arranged side by side inside the housing such that the medicine feeder storing units can be drawn out of the housing, and each include a plurality of medicine feeders configured to store medicines to sequentially discharge the medicines, and a medicine feeder storing case configured to house the plurality of medicine feeders. The linear guide mechanisms are configured to guide the plurality of medicine feeder storing units to linearly move. The plurality of medicine guide assemblies are each disposed between a pair of adjacent medicine feeder storing units among the plurality of medicine feeder storing units, and configured to guide the medicines discharged from the plurality of medicine feeders included in the pair of medicine feeder storing units to an exit port located downward. The medicine collecting assembly is disposed in the housing below the medicine guide assemblies to collect the medicines dropped from the medicine guide assemblies. The packing device is provided in the housing below the medicine collecting assembly to separately pack the medicines discharged from the medicine collecting assembly. The medicine guide assemblies are each constituted from first and second split guide members that are combined with each other when the pair of medicine feeder storing units are housed in the housing and that are separated from each other when one of the pair of medicine feeder storing units is drawn out of the housing. The first split guide member is fixed to the medicine feeder storing case of one of the pair of medicine feeder storing units. The second split guide member is fixed to the medicine feeder storing case of the other of the pair of medicine feeder storing units.

In the medicine dispensing apparatus according to the present invention, in particular, the plurality of linear guide mechanisms are configured such that a gap between a pair of guide paths of a pair of the linear guide mechanisms configured to guide the pair of medicine feeder storing units becomes wider in a drawing direction in which the medicine feeder storing units are drawn out. This makes it possible to reduce rubbing between respective opposed surfaces of the pair of medicine feeder storing units compared to a case where the pair of medicine feeder storing units are drawn out of and pushed into the housing in parallel with each other. That is, with the configuration described above, when a medicine feeder storing unit is drawn out of the housing, the medicine feeder storing unit being drawn out and a medicine feeder storing unit that is adjacent thereto are moved away from each other. As a result, the pair of medicine feeder storing units abut against each other only when the two medicine feeder storing units are pushed deep into the housing. Therefore, it is possible to significantly reduce the possibility that dust is generated through rubbing and adheres to the medicines except at one end side of the guide paths. The drawing mechanism may be used singly, rather than being combined with the structure including the temporary storage structures and the fall prevention member discussed earlier.

The medicine dispensing apparatus may further include a lock mechanism that, when one of the pair of medicine feeder storing units is drawn out, is operable to prevent drawing out a medicine feeder storing unit that is adjacent to the one of the pair of medicine feeder storing units but that does not constitute the pair of medicine feeder storing units. If the drawing structure described above is adopted, the gap between the medicine feeder storing unit being drawn out and a medicine feeder storing unit that is adjacent to but that is not paired with the medicine feeder storing unit being drawn out becomes narrower. Therefore, when a plurality of medicine feeder storing units closely arranged side by side are drawn out, two medicine feeder storing units that are adjacent to each other but that do not constitute a pair may interfere with each other to incur an undesirable event such as deformation or a failure. However, the lock mechanism prevents a medicine feeder storing unit, which may interfere with the medicine feeder storing unit that is being drawn out, from being drawn forward out of the housing, thereby avoiding an undesirable event.

When one of the pair of medicine feeder storing units is drawn out, the lock mechanism may prevent drawing out any of the medicine feeder storing units other than the one of the pair of medicine feeder storing unit.

The medicine dispensing apparatus according to the present invention may further include a plurality of temporary storage structures and a simultaneous driving mechanism. The plurality of temporary storage structures each include a storage portion configured to temporarily store the medicines dropped from the plurality of medicine guide assemblies and an open-close mechanism. Each open-close mechanism is configured to bring the storage portion into a storage enabling state, upon application of a closing drive force, to allow storage of the dropped medicines and to bring the storage portion into a releasing state, upon application of an opening drive force, to discharge the medicines downward from the storage portion upon. The plurality of temporary storage structures are each provided such that the entirety of each temporary storage structure or a portion of each temporary storage structure including the open-close mechanism is drawable out of the housing. The simultaneous driving mechanism is configured to simultaneously apply the closing drive force or the opening drive force to the open-close mechanisms of the plurality of temporary storage structures. In this case, the medicine collecting assembly is disposed in the housing below the plurality of temporary storage structures to collect the medicines dropped from the plurality of temporary storage structures. The entirety of each of the temporary storage structures is coupled to one of the first and second split guide members, or a part of each of the temporary storage structures is disposed at one of the first and second split guide members and the remainder of each of the temporary storage structures is disposed at the other of the first and second split guide members. A plurality of coupling structures are configured to couple the simultaneous driving mechanism and the open-close mechanisms of the plurality of temporary storage structures. The coupling structures are each configured to release the coupling when the medicine feeder storing unit is drawn out of the housing to draw the entirety of each temporary storage structure or the portion of each temporary storage structure including the open-close mechanism out of the housing, and to establish the coupling when the medicine feeder storing unit is pushed into the housing to push the entirety of each temporary storage structure or the portion of each temporary storage structure including the open-close mechanism into the housing. Each temporary storage structure further includes a fall prevention member configured to prevent the medicines in the storage portion from falling down when one of the first and second split guide members is drawn out of the housing. The fall prevention member is removable, and located to enable an inside of the storage portion to be cleaned when the fall prevention member is removed.

If the entirety of each temporary storage structure or the portion of each temporary storage structure including the open-close mechanism is disposed at one of the first split storage member and the second split storage member, when one of a pair of adjacent medicine feeder storing units is drawn out of the housing, the temporary storage structure or the portion of the temporary storage structure is also drawn out together with the first or second split guide member. Therefore, the temporary storage structures can also be cleaned one by one in a comfortable posture while the medicine falling path surrounding surfaces inside the medicine guide assemblies are wiped. In addition, when the pair of medicine feeder storing units are accommodated in the housing, the temporary storage structure is also returned into the housing together with the medicine guide assembly, and coupled to the simultaneous driving mechanism to become operable. Therefore, the medicine dispensing apparatus according to the present invention facilitates cleaning of not only the inner surfaces of the medicine guide assemblies but also the inner surfaces of the temporary storage structures. Moreover, the temporary storage structures each further include a fall prevention member configured to prevent the medicines in the storage portion from falling down when one of the first and second split guide members is drawn out of the housing. Thus, the medicine dispensing apparatus according to the present invention provides high safety without a risk that the tablets may fall into a wrong space while one of the first and second split guide members is drawn out. After one of the first and second split guide members is drawn out, the fall prevention member may be removed to easily and immediately expose the medicine falling path surrounding surfaces inside the storage portion of the temporary storage structure. Wiping, cleaning, or the like of the inside of the storage portion of the temporary storage structure can also be performed with the worker facing the surface to be cleaned. Thus, according to the present invention, it is possible to provide a medicine dispensing apparatus in which temporarily stored tablets can be prevented from undesirably falling down even while a temporary storage structure is drawn out in accompaniment with medicine guide members, and in which the temporary storage structure can be cleaned in a confronting manner after the temporary storage structure is drawn out.

The temporary storage structures may each be constructed by combining a thin and long frame member having an upper-end opening portion and a lower-end opening portion and the open-close mechanism. In this case, the frame member may include a first sidewall portion, a second sidewall portion, a third sidewall portion, and a fourth sidewall portion. The first sidewall portion extends in a drawing direction in which the medicine feeder storing units are drawn out, and is coupled to one of the first and second split guide members. The second sidewall portion is opposed to the first sidewall portion with a gap therebetween. The third sidewall portion extends in a direction orthogonal to the drawing direction to couple one end of the first sidewall portion and one end of the second sidewall portion. The fourth sidewall portion extends in a direction orthogonal to the drawing direction to couple the other end of the first sidewall portion and the other end of the second sidewall portion. For the temporary storage structures each including such a frame member, the fall prevention member preferably defines at least a part of the second sidewall portion. In this case, the open-close mechanism defines the storage portion together with the second sidewall portion when the open-close mechanism is closed. If at least a part of the second sidewall portion of the frame member is defined by the fall prevention member, a surface of the open-close mechanism located on the storage portion side can be exposed by removing the fall prevention member. As a result, regions of the temporary storage structures through which the tablets pass can be easily cleaned.

The first split guide member may include a first opposed wall formed with a plurality of discharge holes to allow passage of the medicines discharged from the plurality of medicine feeders included in the one of the medicine feeder storing units. The second split guide member includes a second opposed wall, a first sidewall, and a second sidewall. The second opposed wall is formed with a plurality of discharge holes to allow passage of the medicines discharged from the plurality of medicine feeders included in the other of the medicine feeder storing units. The first sidewall extends along a first edge portion of the second opposed wall, which is located in a drawing direction in which the medicine feeder storing units are drawn out, and extends in a direction away from the second opposed wall. The second sidewall extends along a second edge portion of the second opposed wall, which is located in the direction opposite to the drawing direction, and extends in a direction away from the second opposed wall. The temporary storage structures are each constituted from first and second split storage members that are combined with each other when the pair of medicine feeder storing units are housed in the housing and that are separated from each other when one of the pair of medicine feeder storing units is drawn out of the housing. The first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism. The first split storage member includes a first extended opposed wall coupled to the first opposed wall of the first split guide member. The second split storage member includes a second extended opposed wall, a first extended sidewall, and a second extended sidewall. The second extended opposed wall is continuous with the second opposed wall of the second split guide member. The first extended sidewall extends along a first edge portion of the second extended opposed wall, which is located in the drawing direction, and extends in a direction away from the second extended opposed wall to be continuous with the first sidewall. The second extended sidewall extends along a second edge portion of the second extended opposed wall, which is located in the direction opposite to the drawing direction, and extends in a direction away from the second extended opposed wall to be continuous with the second sidewall. The fall prevention member is disposed to oppose the second extended opposed wall and extend over the first extended sidewall and the second extended sidewall, and sized and shaped to define a medicine visual recognition portion that enables a worker to visually recognize that the medicines remain inside the storage portion. Even if the temporary storage structures are each split into the first and second split storage members, it is possible to prevent the medicines from falling down from the storage portion when the medicine feeder storing unit including the second split guide member is drawn out by providing the second split storage member including the open-close mechanism with the fall prevention member. In addition, it can be checked through the medicine visual recognition portion whether or not the medicines are stored in the storage portion before cleaning, which prevents the medicines from being scattered over the floor. Even if the fall prevention member is sized and shaped to define the medicine visual recognition portion, the presence of the first split storage member prevents the medicines from falling down through the medicine visual recognition portion during operation of the dispensing device. In addition, the provision of the medicine visual recognition portion makes it possible to visually check the internal state of the temporary storage structure to determine the necessity for cleaning performed with the fall prevention member removed.

If the medicine guide assembly is split into the first and second split guide members and the temporary storage structure is split into the first and second split storage members, the first and second split guide members and the first and second split storage members may be configured as follows. That is, the first split guide member includes a first opposed wall formed with a plurality of discharge holes to allow passage of the medicines discharged from the plurality of medicine feeders included in the one of the medicine feeder storing units. The second split guide member includes a second opposed wall, a first sidewall, a second sidewall, a first guide member, and a second guide member. The second opposed wall is formed with a plurality of discharge holes to allow passage of the medicines discharged from the plurality of medicine feeders included in the other of the medicine feeder storing units. The first sidewall extends along a first edge portion of the second opposed wall, which is located in a drawing direction in which the medicine feeder storing units are drawn out, and extends in a direction away from the second opposed wall. The second sidewall extends along a second edge portion of the second opposed wall, which is located in the direction opposite to the drawing direction, and extends in a direction away from the second opposed wall. The first guide member is removable, and includes a first inclination surface that is continuous with an inner wall surface of the first sidewall and inclined to be closer to the second sidewall. The second guide member is removable, and includes a second inclination surface that is continuous with an inner wall surface of the second sidewall and inclined to be closer to the first sidewall. The temporary storage structures are each constituted from first and second split storage members that are combined with each other when the pair of medicine feeder storing units are housed in the housing and that are separated from each other when one of the pair of medicine feeder storing units is drawn out of the housing. The first split storage member is disposed at the first split guide member of the medicine guide assembly, and the second split storage member is disposed at the second split guide member of the medicine guide assembly as the portion of the temporary storage structure including the open-close mechanism. The first split storage member includes a first extended opposed wall coupled to the first opposed wall of the first split guide member. The second split storage member includes a second extended opposed wall that is continuous with the second opposed wall of the second split guide member, and the fall prevention member removably disposed at the second extended opposed wall. In this case, the fall prevention member includes a first attachment portion, a second attachment portion, and a bridging portion. The first attachment portion includes a first extended surface that is continuous with the first inclination surface to extend downward when the fall prevention member is attached to the second extended opposed wall. The second attachment portion includes a second extended surface that is continuous with the second inclination surface to extend downward when the fall prevention member is attached to the second extended opposed wall. The bridging portion is disposed to oppose the second extended opposed wall, and extends over the first attachment portion and the second attachment portion, and is disposed to define a medicine visual recognition portion that enables a worker to visually recognize that the medicines remain inside the storage portion. With such a configuration, the second split guide member and the second extended opposed wall of the second split storage member disposed at the second split guide member are entirely exposed by removing the first and second guide members and removing the fall prevention member, which advantageously facilitates cleaning work. In addition, the configuration also allows checking whether the medicines are stored in the storage portion before removing the fall prevention member, which prevents the medicines from unnecessarily falling down. The oblique surfaces of the first and second guide members facing obliquely upward are soiled with stubborn stains from the tablets, and are difficult to clean. If the first and second guide members are used as in the configuration described above, however, the oblique surfaces can be cleaned when the first and second guide members are removed, which lessens the difficulty of cleaning.

The first and second guide members and the fall prevention member are preferably attached using a removable attachment structure such as a magnet, a surface fastener, and a retaining structure. Use of such an attachment structure allows the first and second guide members and the fall prevention member to be attached and removed without using a special tool.

It is a matter of course that the structure which facilitates cleaning described above may also be applied to the medicine dispensing apparatus according to the related art in which a gap between a pair of guide paths of a pair of linear guide mechanisms configured to guide a pair of medicine feeder storing units does not become wider in a drawing direction in which the medicine feeder storing units are drawn out.

BRIEF DESCRIPTION OF DRAWINGS

FIG. 11 generally illustrates the structure of a medicine guide assembly and a temporary storage structure of a medicine dispensing apparatus according to a third embodiment of the present invention, in which

FIG. 12 generally illustrates the structure of a medicine dispensing apparatus according to the related art.

FIG. 13 generally illustrates the structure of a prototype medicine dispensing apparatus with a drawable temporary storage mechanism.

DESCRIPTION OF EMBODIMENTS

A medicine dispensing apparatus according to an embodiment of the present invention will be described in detail below.

FIGS. 1 to 8 illustrate the configuration of a medicine dispensing apparatus according to a first embodiment of the present invention. In FIGS. 1 to 8, for the sake of clarity etc., fasteners such as bolts, couplers such as hinges, driving sources such as electric motors, power transmission members such as timing belts, electric circuits such as motor drivers, and electronic circuits such as controllers are not illustrated in detail, and members necessary for or related to description of the present invention are mainly illustrated.

Figure 13A:
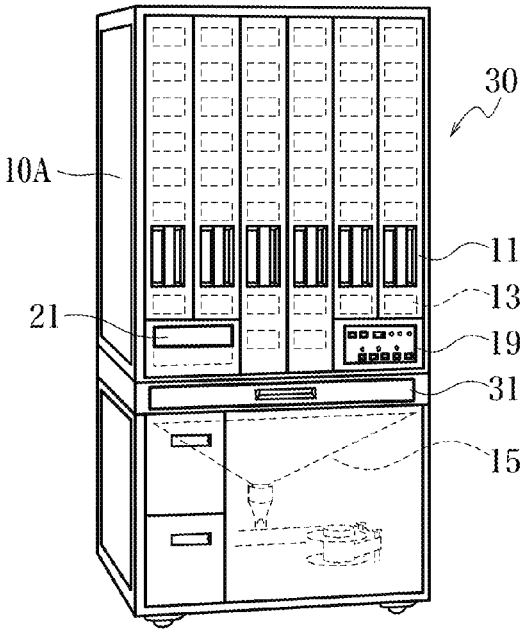
FIG. 13A is a perspective view illustrating the appearance of the medicine dispensing apparatus as seen from the left front.
Figure 13B:
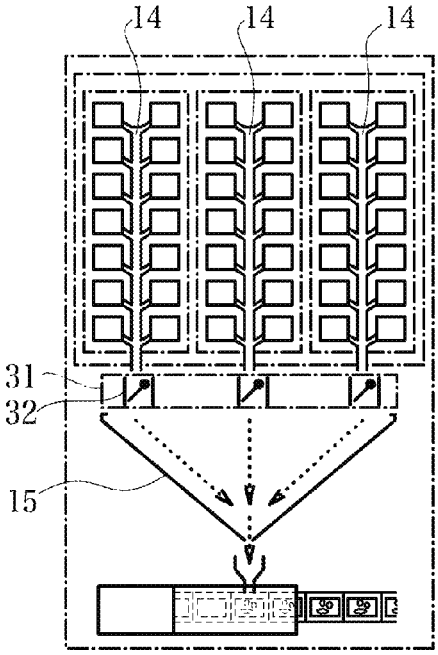
FIG. 13B is a schematic view illustrating the internal structure of the medicine dispensing apparatus.
Figure 13C:
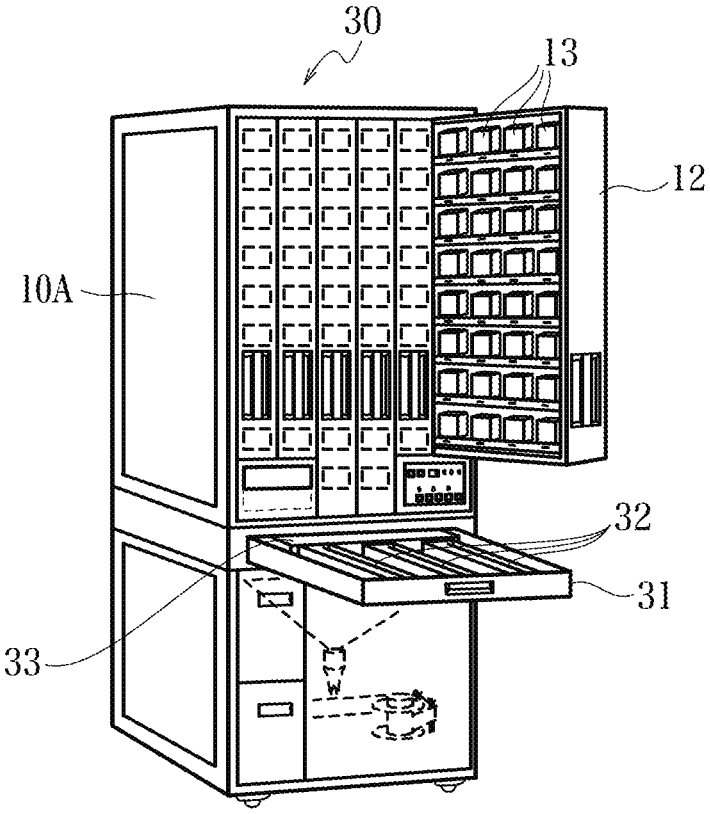
FIG. 13C is a perspective view illustrating the appearance of the medicine dispensing apparatus as seen from the left front.
Figure 14A:
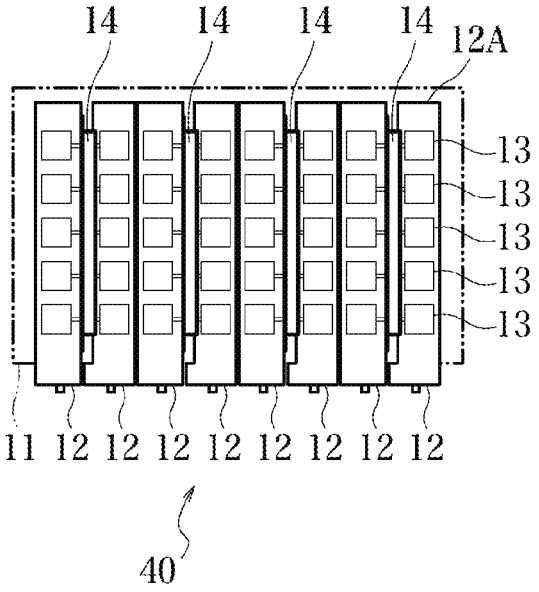
FIGS. 14A and 14B are each a plan view illustrating the structure of an essential portion of a medicine dispensing apparatus with vertically split medicine guide assemblies.
Figure 14B:
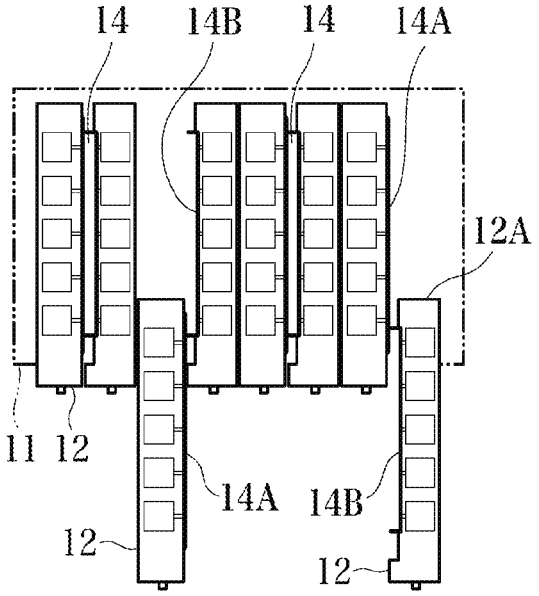
Figure 15A:
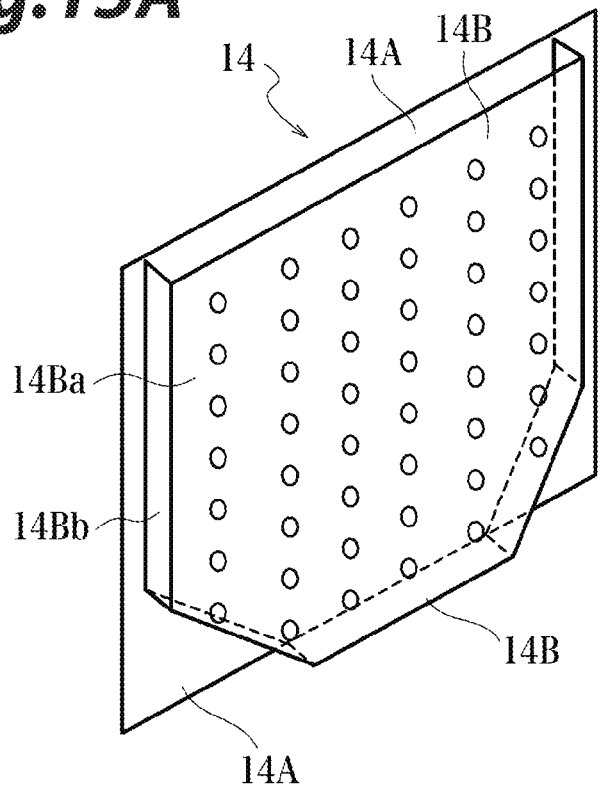
FIG. 15A is a perspective view of a medicine guide assembly as seen from the right and obliquely above.
Figure 15B:
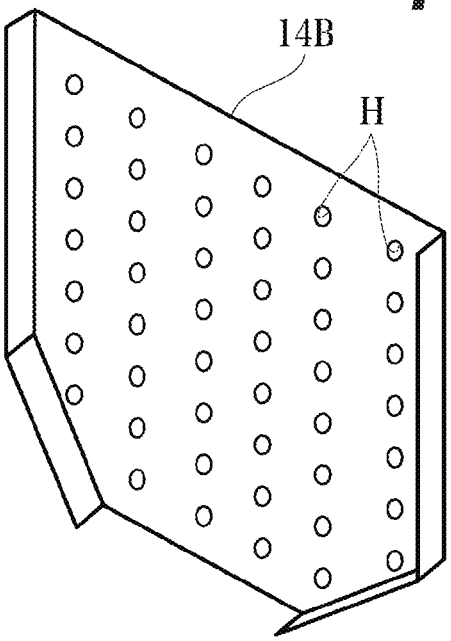
FIG. 15B is a perspective view of a second split guide member as seen from the left and obliquely above.

In FIGS. 1 to 8, component parts similar to those of the medicine dispensing apparatuses 10 to 30 according to the related art illustrated in FIGS. 12 and 13 and the medicine dispensing apparatus 40 proposed by the applicant illustrated in FIGS. 14 and 15 are denoted by reference numerals obtained by adding 100 to the reference numerals affixed to their counterparts in FIGS. 12 to 14. The medicine dispensing apparatus according to the embodiment is a medicine dispensing apparatus 110 which is a typical example of the medicine dispensing apparatus. FIGS. 1A and 1B are each a plan view, FIG. 1C is a front view, and FIG. 1D is a right side view, of the medicine dispensing apparatus 110 according to the embodiment. FIG. 2A illustrates the state of arrangement of medicine feeder storing units 112, medicine guide assemblies 114, and linear guide mechanisms 150. FIG. 2B illustrates the state of arrangement of the medicine feeder storing units 112, the medicine guide assemblies 114, and a lock mechanism 160 with all the medicine feeder storing units 112 pushed into a medicine storage 111. FIG. 2C illustrates a state in which one of adjacent medicine feeder storing units 112 is drawn forward out of the medicine storage 111. FIG. 2D illustrates a state in which the other of the pair of adjacent medicine feeder storing units 112 is drawn forward out of the medicine storage 111. FIG. 2E illustrates extended front panel portions 112*a* as enlarged. FIGS. 3A to 3D are each a plan view illustrating the structure of an essential portion of the medicine feeder storing units 112 and the linear guide mechanisms 150 for the medicine feeder storing units 112 of the medicine dispensing apparatus 110.

The medicine dispensing apparatus 110 includes eight medicine feeder storing units 112, four medicine guide assemblies 114, a medicine collecting assembly 115, a packing device 117, a controller 118, and an operation panel 119. The medicine feeder storing units 112 each include a medicine feeder storing case 112A, and a plurality of medicine feeders 113 housed in the medicine feeder storing case 112A. The plurality of medicine feeders 113 store various types of medicines such as tablets such as pills and capsules separately according to their types. The controller 118 outputs a control command to the plurality of medicine feeders 113 and the packing device 117.

Figure 5A:
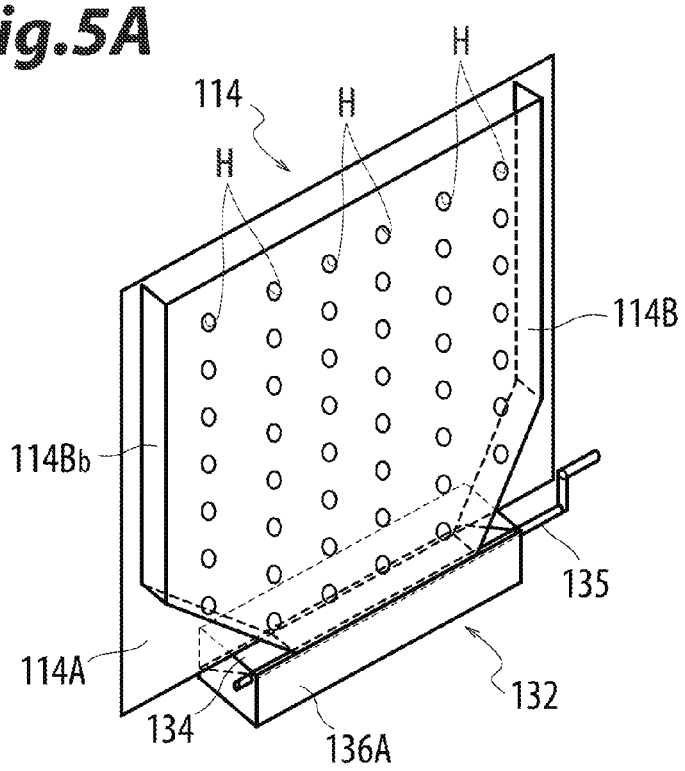
FIG. 5A is a perspective view of a structure including a medicine guide assembly composed of first and second split guide members and a temporary storage structure as seen from the right and obliquely above.

The medicine storage 111 includes the eight individually slidable medicine feeder storing units 112 disposed side by side with each other. In the embodiment, the four medicine guide assemblies 114 are each disposed between a pair of adjacent medicine feeder storing units 112 among the eight medicine feeder storing units 112. The medicine guide assembly 114 guides the medicines discharged from the plurality of medicine feeders 113 included in the pair of medicine feeder storing units 112 to an exit port located downward or downstream. The medicine guide assemblies 114 are each constituted from first and second split guide members 114A and 114B that are combined with each other when the pair of medicine feeder storing units 112 are housed in the housing 110A and that are separated from each other when one of the pair of medicine feeder storing units 112 is drawn out of the housing 110A. The housing 110A has open-close doors, which are opened when the medicine feeder storing units 112 are to be drawn out of the housing 110A. The first split guide member 114A is fixed to the medicine feeder storing case 112A of one of the pair of medicine feeder storing units 112. As illustrated in FIG. 5, a first opposed wall of the first split guide member 114A is formed with a plurality of communication holes H to allow passage of the medicines discharged from the plurality of medicine feeders 113 included in the medicine feeder storing units 112. The second split guide member 114B including the temporary storage structure 132 is fixed to the medicine feeder storing case 112B of the other of the pair of medicine feeder storing units 112.

Figure 5B:
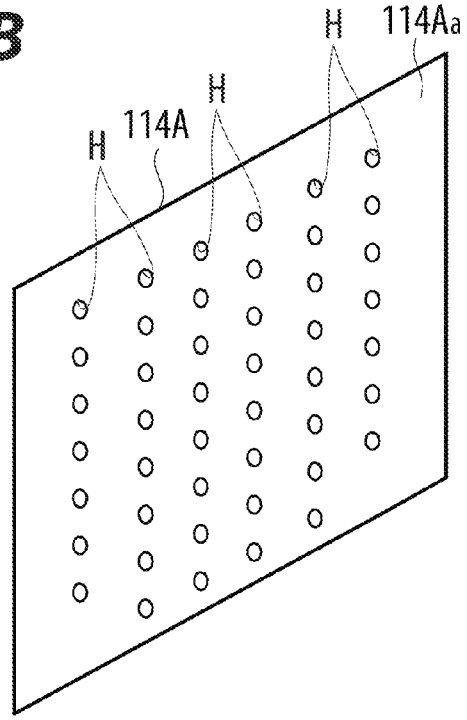
FIG. 5B is a perspective view of the first split guide member as seen from the right and obliquely above.
Figure 5C:
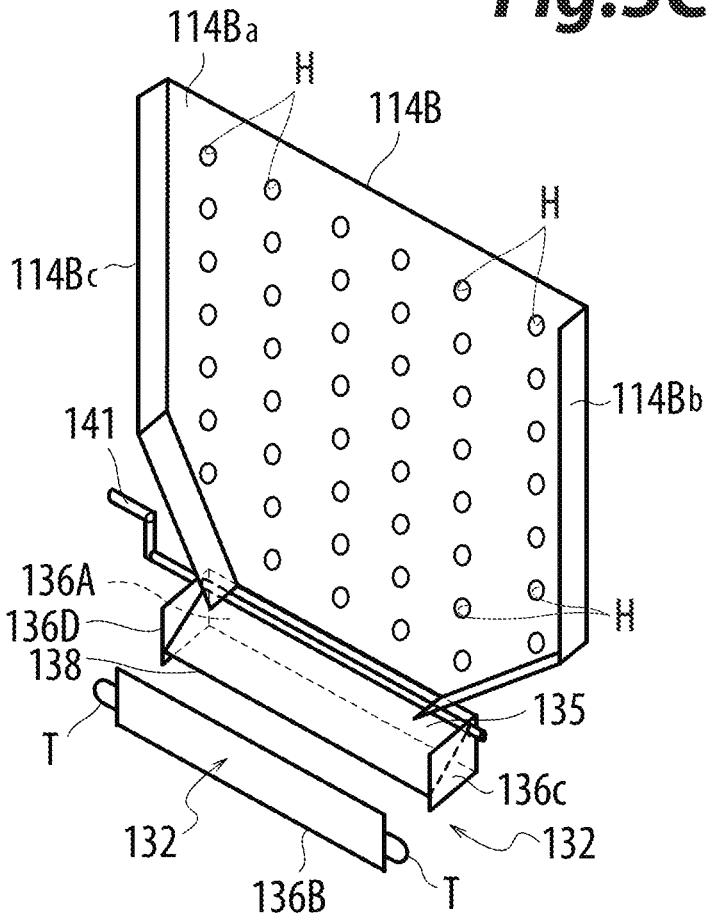
FIG. 5C is a perspective view of the second split guide member including the temporary storage structure as seen from the left and obliquely above.

As illustrated in FIG. 5B, the first split guide member 114A has the shape of a plate formed with a plurality of communication holes H to allow passage of the medicines discharged from medicine discharge ports of the plurality of medicine feeders 113 included in the one of the medicine feeder storing units 112. The second split guide member 114B includes a second opposed wall 114Ba, a first sidewall 114Bb, and a second sidewall 114Bc. The second opposed wall 114Ba is formed with a plurality of communication holes H to allow passage of the medicines discharged from the plurality of medicine feeders 113 included in the other of the medicine feeder storing units 112. The first sidewall 114Bb extends along a first edge portion of the second opposed wall 114Ba, which is located in a drawing direction in which the medicine feeder storing units are drawn out, and extends in a direction away from the second opposed wall 114Ba. The second sidewall 114Bc extends along a second edge portion of the second opposed wall 114Ba, which is located in the direction opposite to the drawing direction, and extends in a direction away from the second opposed wall 114Ba. In order to increase the alignment tolerance, the width of the plate-shaped first split guide member 114A is slightly larger than that of the second opposed wall 114Ba of the second split guide member 114B. In the embodiment, the entirety of the temporary storage structure 132 to be described in detail later is fixed to the second opposed wall 114Ba. Thus, when the medicine feeder storing case 112B of the other of the pair of medicine feeder storing units 112 is drawn out, the second split guide member 114B and the temporary storage structure 132 are drawn out together.

The medicine guide assembly 114 constituted from the first and second split guide members 114A and 114B provided opposite to each other is open in its upper and lower ends. The medicine guide assembly 114 guides a fall of all the medicines discharged from a large number of medicine feeders 113 mounted to the corresponding pair of adjacent medicine feeder storing units 112. The lower end portion of the medicine guide assembly 114 is tapered to be slightly narrow at its lower-end opening so that the front-rear dimension of the upper opening of the temporary storage structure 132 can be reduced.

If the medicine guide assembly constituted from the first and second split guide members 114A and 114B is provided for the pair of medicine feeder storing units, the number of the medicine guide assemblies 114 can be reduced to half the number of the medicine feeder storing units 112. Thus, the product can be made compact compared to that according to the related art. Adopting such a configuration allows the medicine feeder storing unit 112 to be drawn out of the housing 110A with the inside of the first or second split guide member 114A or 114B exposed. Therefore, the inside of the first and second split guide member 114A and 114B can be individually cleaned, which makes it possible to clean the medicine guide assembly 114 without putting an excessive burden on the worker.

Figure 4A:
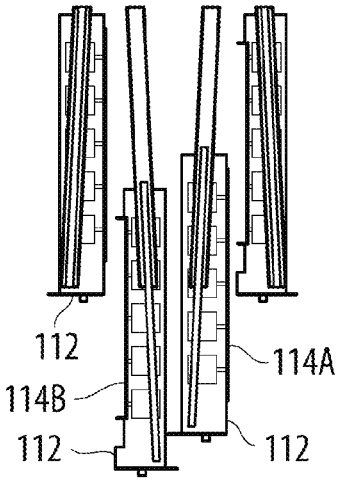
FIGS. 4A to 4F illustrate the structure of a lock mechanism for the drawing mechanisms for the medicine feeder storing units of the medicine dispensing apparatus according to the first embodiment of the present invention.
Figure 4B:
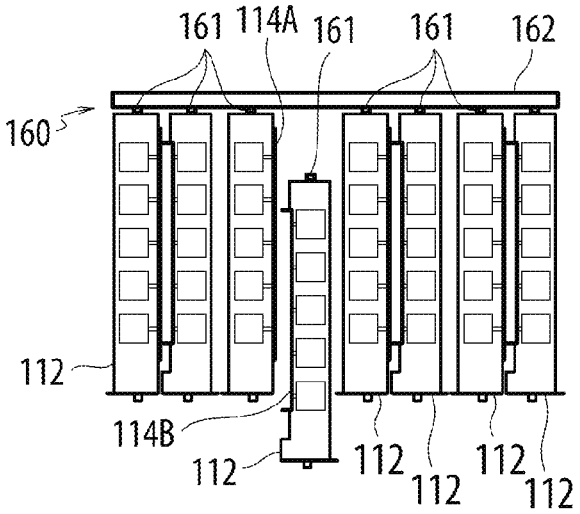
Figure 4C:
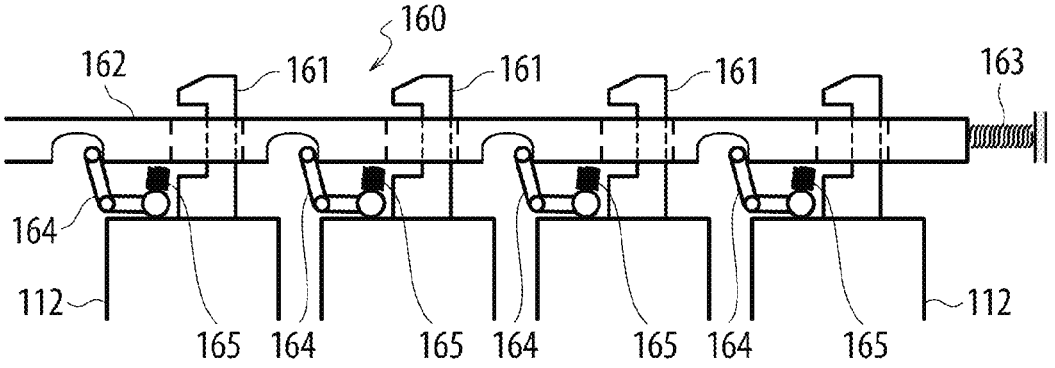
Figure 4D:
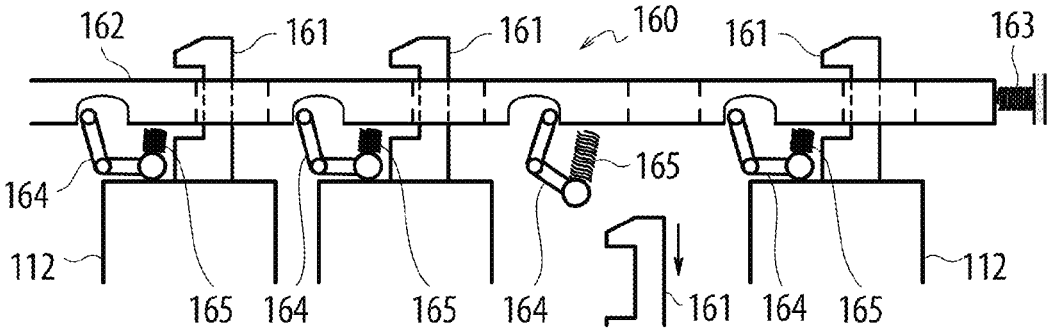
Figure 4E:
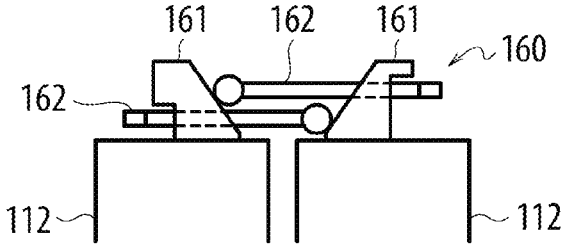
Figure 4F:
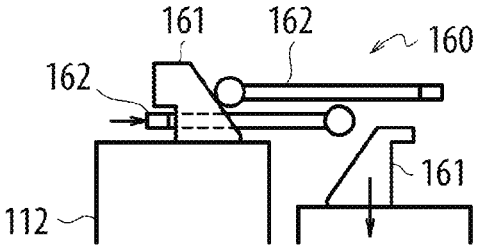

FIG. 4A illustrates a state in which a plurality of medicine feeder storing units 112 are drawn out at the same time. FIG. 4B illustrates a state in which the lock mechanism 160 functions when one of the medicine feeder storing units 112 is drawn out. FIG. 4C is an enlarged view of the lock mechanism 160 with all the medicine feeder storing units 112 pushed into the medicine storage 111. FIG. 4D is an enlarged view of the lock mechanism 160 with one of the medicine feeder storing units 112 drawn out. FIGS. 4E and 4F are each an enlarged view of a lock mechanism 160 according to another configuration example.

The medicine dispensing apparatus 110 according to the embodiment is configured such that a gap between guide paths of a pair of the linear guide mechanisms 150 configured to guide the pair of medicine feeder storing units 112 becomes wider in a drawing direction in which the medicine feeder storing units 112 are drawn out. The linear guide mechanisms 150 (see FIGS. 2 and 3) are each constituted from a linear rail mechanism including a fixed guide portion 151 [FIG. 3B] fixed to the housing 110A or the medicine storage 111 and a movable slide portion 152 mounted to the medicine feeder storing unit 112, for example. When the movable slide portion 152 slidably combined with the fixed guide portion 151 slides in the longitudinal direction of the fixed guide portion 151, the medicine feeder storing unit 112 is advanced and retracted. As illustrated, the linear guide mechanisms 150 are disposed above the medicine feeder storing units 112 with the longitudinal direction of the linear guide mechanisms 150 directed in the front-rear direction. However, the linear guide mechanisms 150 may be disposed below the medicine feeder storing units 112, and may be disposed both above and below the medicine feeder storing units 112. In the drawing, the linear guide mechanisms 150 each include only one movable slide portion 152. However, the linear guide mechanisms 150 may each include two movable slide portions 152, and the structure of the linear guide mechanism 150 is not limited.

The plurality of linear guide mechanisms 150 are each mounted to the medicine dispensing apparatus 110 with the longitudinal direction or the sliding direction of the linear guide mechanisms 150 extending in the horizontal direction. In the embodiment, the gap between a pair of guide paths of a pair of linear guide mechanisms 150 for a pair of medicine feeder storing units 112 (paths along which the movable slide portions 152 slide on the fixed guide portions 151) becomes wider in the drawing direction in which the medicine feeder storing units 112 are drawn out as viewed in plan [see FIGS. 2A and 3]. That is, when a pair of linear guide mechanisms 150 corresponding to a pair of medicine feeder storing units 112 located across each medicine guide assembly 114 are viewed in plan, the gap between guide paths of the pair of linear guide mechanisms 150 is narrower on the rear side (farther side), and wider on the front side (closer side).

In FIGS. 2 and 3, in order to facilitate understanding, the opening angle between each pair of guide paths (the opening angle between each pair of fixed guide portions 151 or the opening angle θ between each pair of movable slide portions 152 and 152) is illustrated as more or less exaggerated. Actually, it is only necessary that the state in which a pair of medicine feeder storing units 112 abut against each other should be immediately resolved as a medicine feeder storing unit 112 is drawn out. Thus, an opening angle θ of about 1° is satisfactory in many cases. The angle is such a small angle that there is substantially no gap between the extended front panel portions 112*a* when a pair of medicine feeder storing units 112 with a length or depth of 60 cm, for example, are pushed into the housing 110A, but that there is a gap of about 1 cm between the extended front panel portions 112*a* when the pair of medicine feeder storing units 112 are both drawn out of the housing 110A. Although not very conspicuous, the proportion of generation of dust due to friction is distinctly different from a case where the gap between a pair of medicine feeder storing units 112 is hardly varied between when the medicine feeder storing units 112 are pushed in and when the medicine feeder storing units 112 are drawn out, that is, a case where the opening angle is 0° and the pair of medicine feeder storing units 112 are parallel with each other.

Figure 1A:
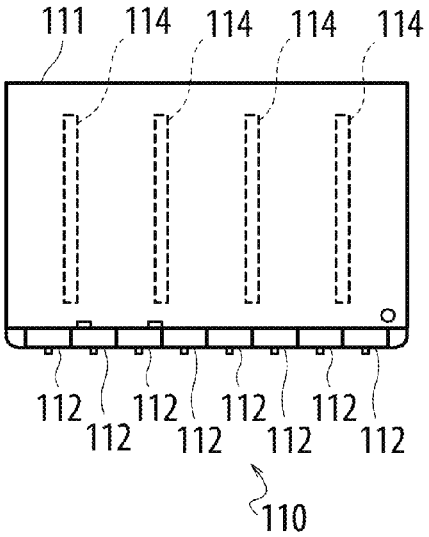
FIGS. 1A and 1B are each a plan view.
Figure 1B:
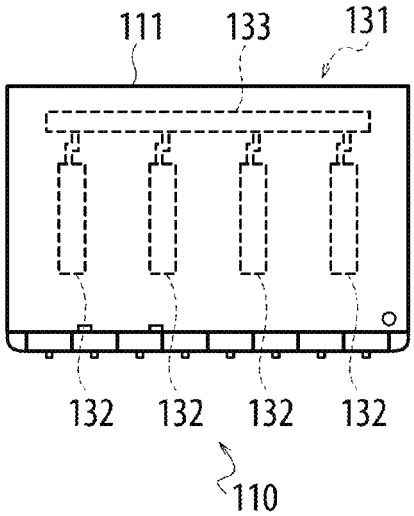
Figure 1C:
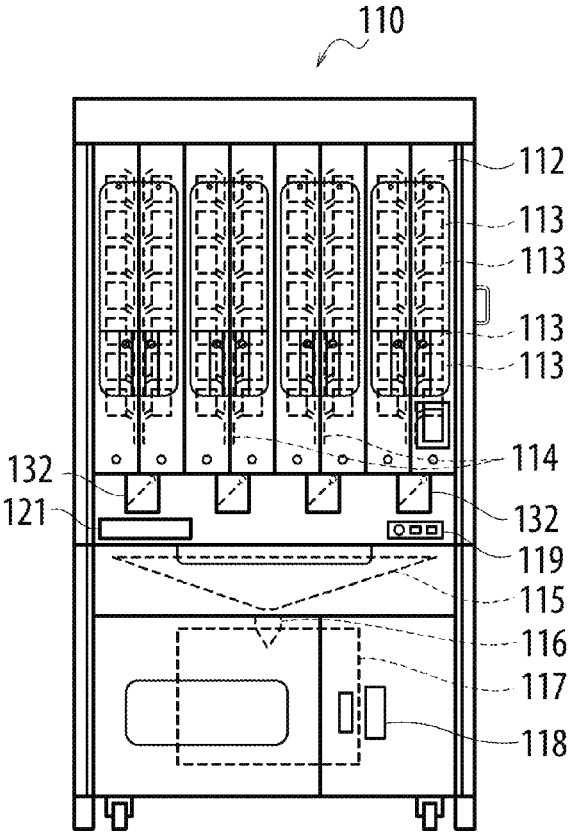
FIG. 1C is a front view.
Figure 1D:
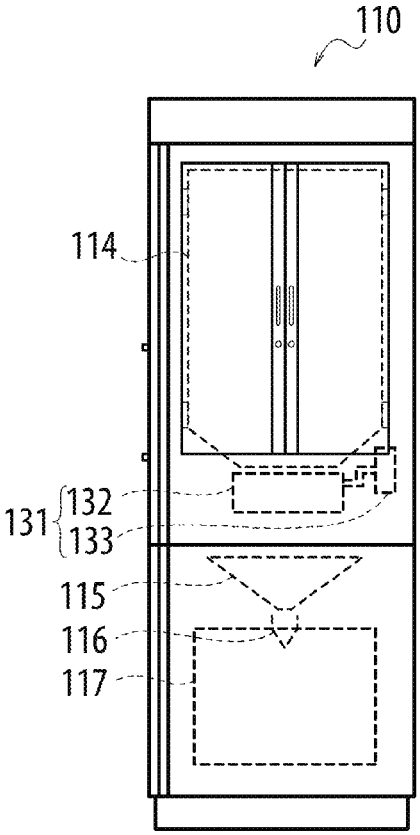
FIG. 1D is a right side view, illustrating the overall structure of a medicine dispensing apparatus according to a first embodiment of the present invention.
Figure 2A:
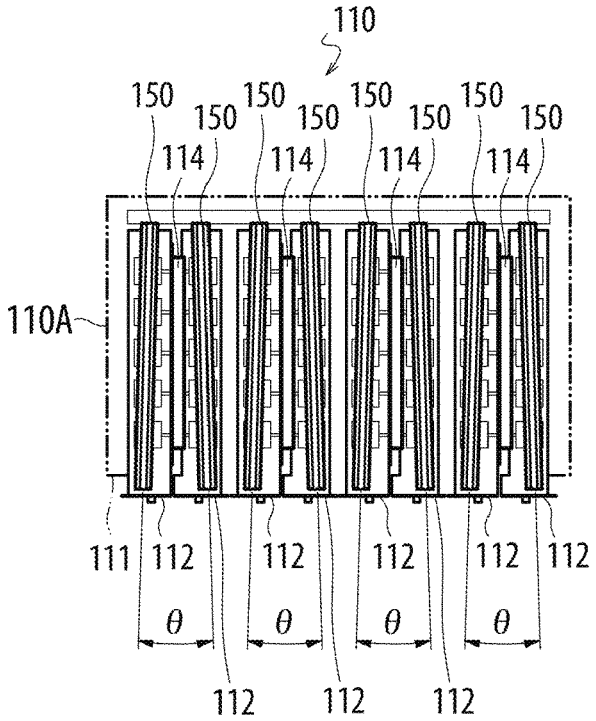
FIGS. 2A to 2E illustrate the structure of an essential portion of the medicine dispensing apparatus according to the first embodiment of the present invention.
Figure 2B:
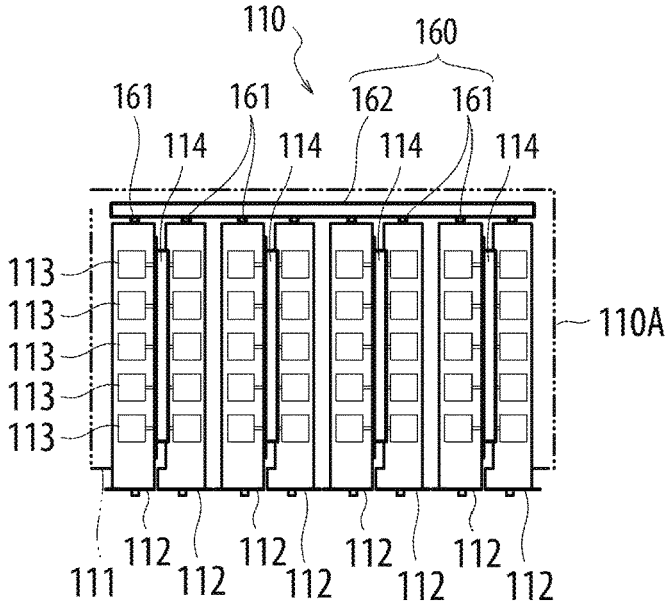
Figure 2C:
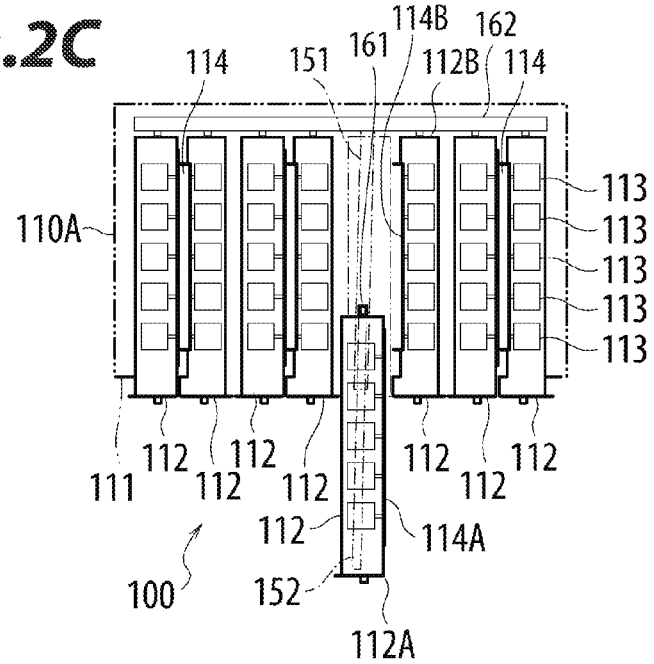
Figure 2D:
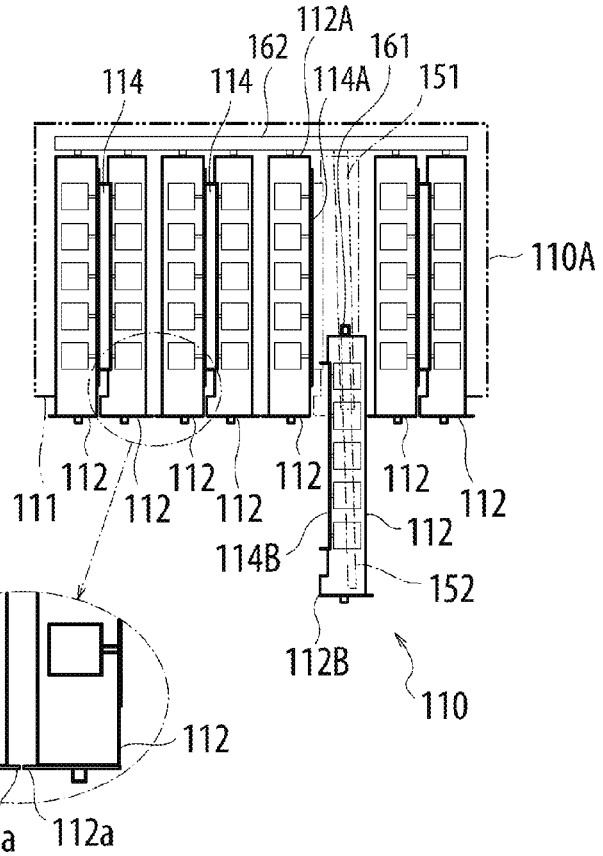
Figure 2E:
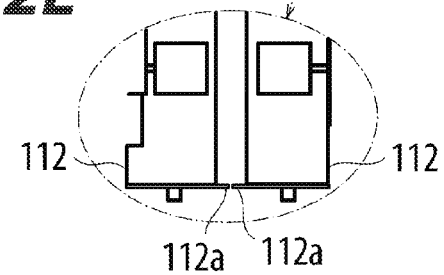
Figure 3A:
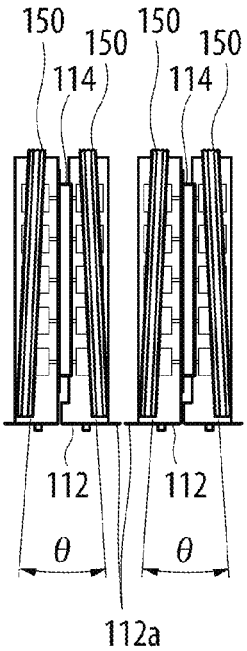
FIGS. 3A to 3D illustrate the structure of an essential portion of medicine feeder storing units and drawing mechanisms for the medicine feeder storing units of the medicine dispensing apparatus according to the first embodiment of the present invention.
Figure 3B:
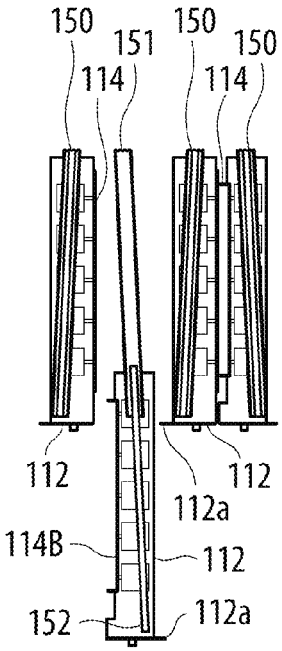

As illustrated in FIGS. 2E, 3A, and 3B, the plurality of medicine feeder storing units 112 are disposed in parallel with each other such that the gap between a pair of guide paths of a pair of adjacent linear guide mechanisms 150 becomes wider in a drawing direction in which the medicine feeder storing units 112 are drawn out (see FIGS. 2E, 3A, and 3B). With this configuration, the medicine feeder storing units 112 are slightly horizontally moved based on the opening angle θ between the pair of guide paths (150) when the medicine feeder storing units 112 are drawn out forward. Then, if the extended front panel portion 112*a* is provided on the left side of the medicine feeder storing unit 112 located on the left side in the pair of the medicine feeder storing units 112, and the extended front panel portion 112*a* is provided on the right side of the medicine feeder storing unit 112 located on the right side in the pair of the medicine feeder storing units 112, interference between the medicine feeder storing units 112 can be avoided when the medicine feeder storing units 112 are drawn out. Also, occurrence of a large gap between the medicine feeder storing units 112 on the front side can be prevented when the medicine feeder storing units 112 are pushed in.

Figure 3C:
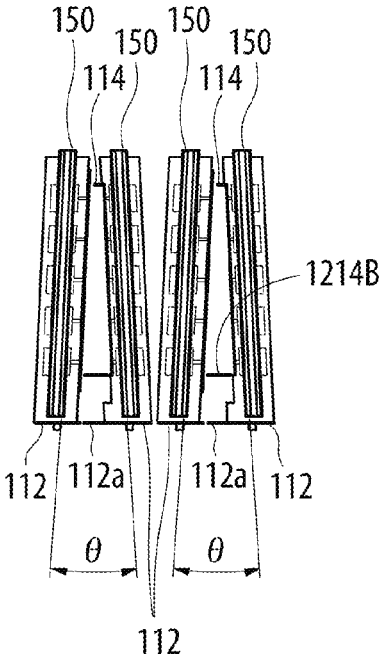
Figure 3D:
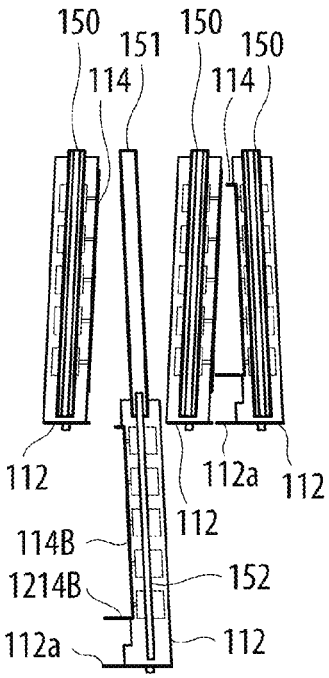

As illustrated in FIGS. 3C and 3D, the pair of medicine feeder storing units 112 may be attached to the pair of linear guide mechanisms 150 such that the gap between the medicine feeder storing units 112 becomes wider in the drawing direction in which the medicine feeder storing units 112 are drawn out (such that an opening angle θ is provided) as with the linear guide mechanisms 150. In this case, the extension length of the extended front panel portion 112*a* of the medicine feeder storing unit 112 on the left side and the extension length of the extended front panel portion 112*a* of the medicine feeder storing unit 112 on the right side are preferably changed such that there is no large gap formed on the front side when the pair of medicine feeder storing units 112 are pushed in. In FIGS. 3C and 3D, a second split guide member 114B is shaped such that no gap that allows medicines to fall into is formed between the pair of medicine feeder storing units 112 when the medicine feeder storing units 112 are pushed in.

In the embodiment, as illustrated in FIGS. 2B to 2D and 4C to 4F, there is provided a lock mechanism 160 that, when one of the pair of medicine feeder storing units 112 is drawn out, is operable to prevent drawing out a medicine feeder storing unit 112 that is adjacent to the one of the pair of medicine feeder storing units 112 but that does not constitute the pair of medicine feeder storing units 112. That is, if the gap between the pair of guide paths of the pair of linear guide mechanisms 150 becomes wider in the drawing direction in which the medicine feeder storing units 112 are drawn out, the gap between the medicine feeder storing unit 112 being drawn out and a medicine feeder storing unit 112 that is adjacent to but that is not paired with the medicine feeder storing unit 112 being drawn out becomes narrower as illustrated in FIG. 3A. Therefore, when two medicine feeder storing units 112 that are adjacent to each other but that do not constitute a pair are drawn out at the same time, the two medicine feeder storing units 112 may interfere with each other to incur an undesirable event such as deformation or a failure. Thus, the lock mechanism prevents a medicine feeder storing unit that may interfere with the medicine feeder storing unit being drawn out from being drawn forward out of the housing, which prevents occurrence of an undesirable event.

It is only necessary that when one of the pair of medicine feeder storing units 112 is drawn forward out of the medicine storage 111 or the housing, the lock mechanism 160 according to the embodiment should prevent the medicine feeder storing unit 112 (see FIG. 4A) that is adjacent to but that is not paired with the medicine feeder storing unit 112 being drawn out from being drawn forward out of the medicine storage 111 or the housing. In the example illustrated in FIGS. 4B to 4D, when one of the medicine feeder storing units 112 is drawn out of the medicine storage 111 or the housing, all the other medicine feeder storing units 112 are prevented from being drawn out forward. A specific example of such a lock mechanism 160 (see FIGS. 4B to 4D) is of a purely mechanical type, and includes a plurality of lock hook portions 161, a horizontally elongated lock bar portion 162, an unlocking bias spring 163, a plurality of locking links 164, and a plurality of locking bias springs 165. The lock hook portions 161 are provided at the respective rear ends of the medicine feeder storing units 112. The lock bar portion 162 is provided to be engageable with all the lock hook portions 161. The unlocking bias spring 163 is operable to bias the lock bar portion 162 toward an unlocking side. The locking links 164 are provided to abut against the respective rear ends of the medicine feeder storing units 112. The locking bias springs 165 are disposed at the respective locking links 164 to bias the corresponding locking links 164 toward a locking side. The locking links 164 are swingably supported to abut against respective notched portions of the lock bar portion 162.

Then, when all the medicine feeder storing units 112 are pushed into the medicine storage 111 or the housing, all the locking links 164 are swung toward the unlocking side against the bias of the locking bias springs 165. In this state, the lock bar portion 162 is slid toward the unlocking side by the bias of the unlocking bias spring 163, and therefore all the lock hook portions 161 are disengaged from the lock bar portion 162 to be drawable (see FIG. 4C).

When at least one of the medicine feeder storing units 112 is drawn out forward from the state described above (see FIG. 4D), the lock hook portion 161 disposed at the medicine feeder storing unit 112 being drawn out is also advanced to move away from the position of engagement with the lock bar portion 162 (see FIG. 4D). Then, the locking bias spring 165 exerts its bias to swing the locking link 164 toward the locking side. Because the biasing force of the locking bias spring 165 is stronger than that of the unlocking bias spring 163, the lock bar portion 162 is slid toward the locking side. As a result, all the lock hook portions 161 excluding the one being drawn out first are engaged with the lock bar portion 162 to be undrawable.

Specific examples of a mechanism operable to prevent a medicine feeder storing unit 112 that is adjacent to but that is not paired with the medicine feeder storing unit 112 being drawn out from being drawn forward out of the medicine storage 111 or the housing include a simple cam mechanism illustrated in FIGS. 4E and 4F. The mechanism uses the lock hook portions 161 disposed at the rear ends of the medicine feeder storing units 112 as drivers, and the lock bar portions 162 provided in the rear portion of the housing to horizontally slide as followers. Then, when a medicine feeder storing unit 112 is pushed into the medicine storage 111 or the housing, the lock hook portion 161 slides the corresponding lock bar portion 162 to unlock the lock hook portion 161 of an adjacent medicine feeder storing unit 112 (see FIG. 4E). In the structure of FIG. 4F, in contrast, when a medicine feeder storing unit 112 is drawn out forward, the lock hook portion 161 is advanced together (see FIG. 4F), which allows the lock bar portion 162 to slide to lock the lock hook portion 161 of an adjacent medicine feeder storing unit 112.

Figure 6:
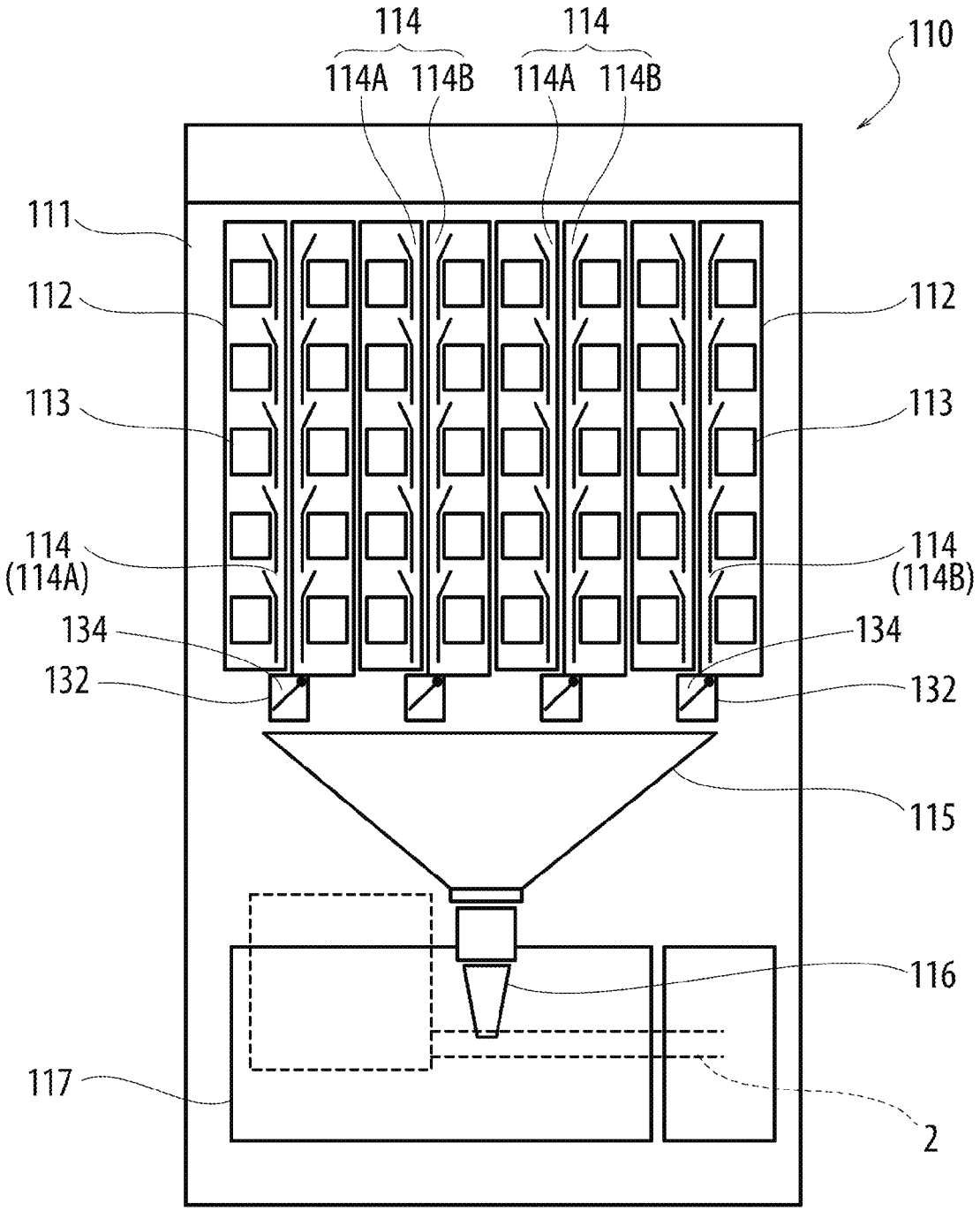
FIG. 6 is a schematic view illustrating the internal structure of the medicine dispensing apparatus.
Figure 7A:
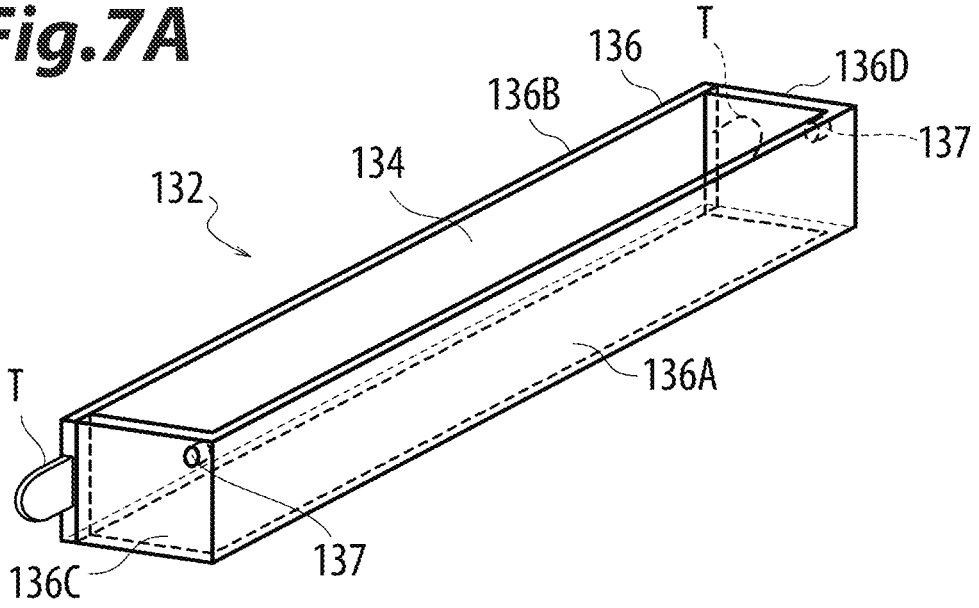
FIG. 7A is a perspective view of a frame member of the temporary storage structure.
Figure 7B:
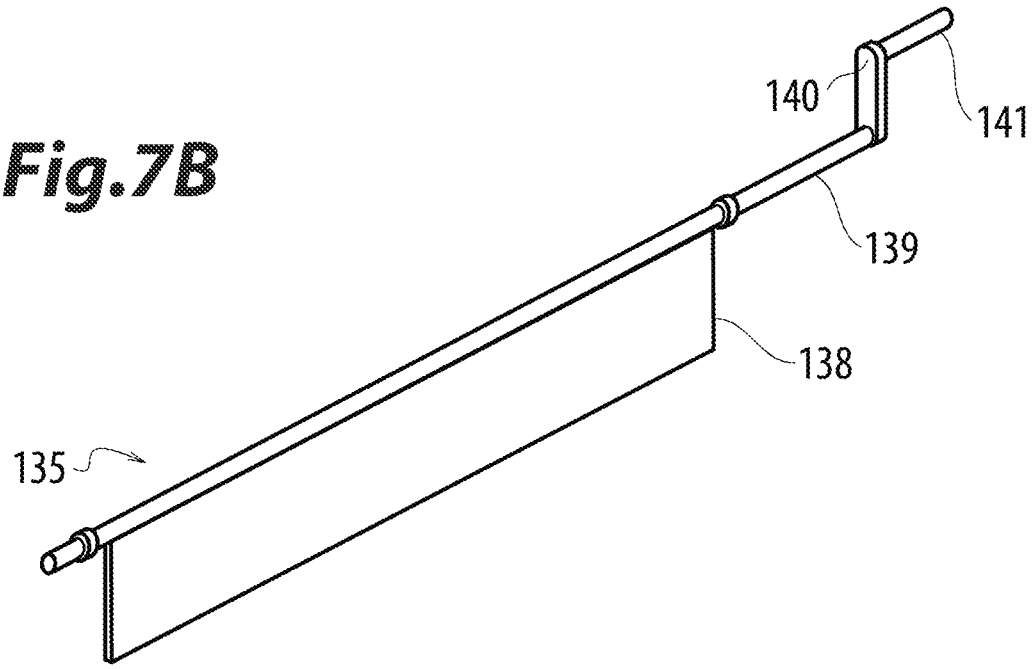
FIG. 7B is a perspective view of an open-close mechanism.
Figure 7C:
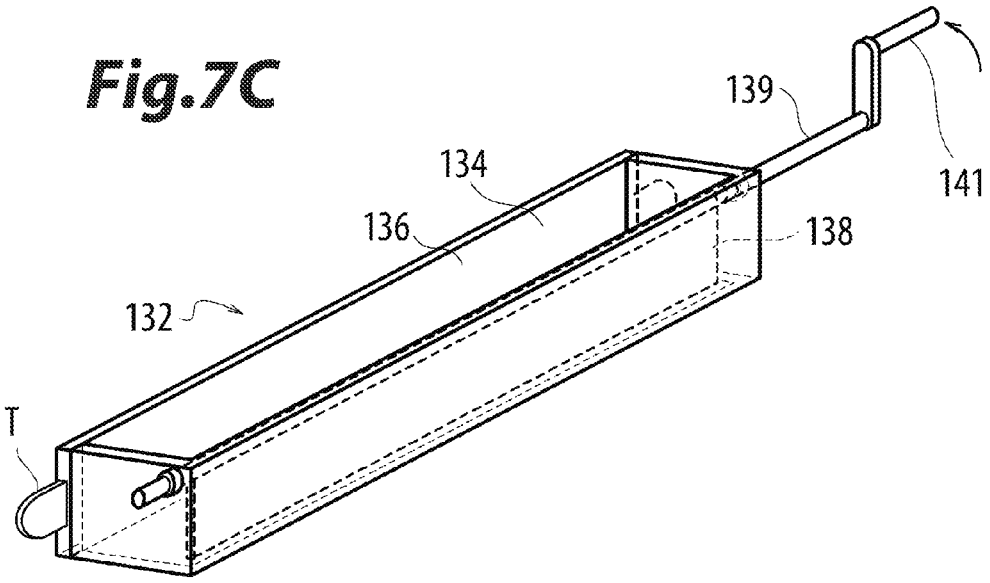
FIGS. 7C and 7D are each a perspective view of the temporary storage structure.
Figure 7D:
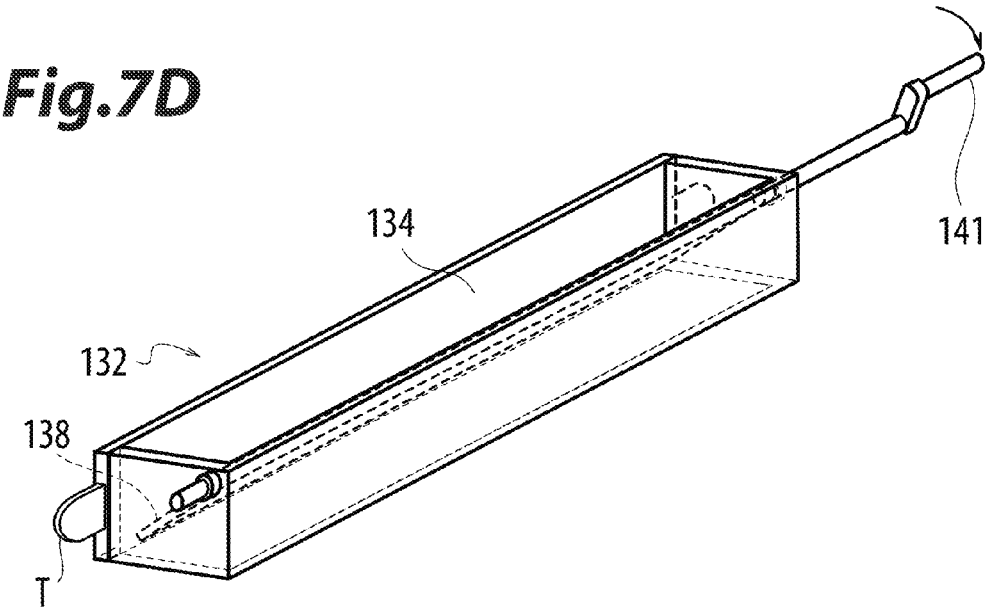

In the embodiment, as illustrated in FIG. 6, the four temporary storage structures 132 are respectively disposed below the four medicine guide assemblies 114 to temporarily store the medicines dropped from the four medicine guide assemblies 114. The four temporary storage structures 132 are driven by a simultaneous driving mechanism 133 configured to actuate the plurality of temporary storage structures 132 at the same time to release the medicines at a time. A temporary storage device 131 is constituted from the four temporary storage structures 132 and the simultaneous driving mechanism 133.

As described in detail later, the temporary storage structures 132 each include a storage portion 134 and an open-close mechanism 135. The storage portion 134 is configured to temporarily store the medicines dropped from the medicine guide assemblies 114. The open-close mechanism 135 is configured to bring the storage portion 134 into a storage enabling state, upon application of a closing drive force, and to bring the storage portion 134 into a releasing state, upon application of an opening drive force, to discharge the medicines downward from the storage portion 134. The temporary storage structures 132 is each provided such that the entirety of each temporary storage structure 132 is drawable out of the housing 110A. The simultaneous driving mechanism 133 illustrated in FIG. 8 applies a closing drive force or an opening drive force to the open-close mechanisms 135 of the four temporary storage structures 132 at the same time. Coupling structures are provided to couple the simultaneous driving mechanism 133 and the open-close mechanisms 135 of the four temporary storage structures 132, and each configured to release the coupling when the entire temporary storage structure 132 is drawn out of the housing 110A, and to establish the coupling when the entire temporary storage structure 132 is pushed into the housing 110A.

As illustrated in FIG. 7, the temporary storage structure 132 used in the embodiment is structured by combining a thin and long rectangular tubular member or a frame member 136 having an upper-end opening portion and a lower-end opening portion (to form the storage portion 134), and the open-close mechanism 135. The frame member 136 (see FIG. 7A) includes a first sidewall portion 136A, a second sidewall portion 136B, a third sidewall portion 136C, and a fourth sidewall portion 136D. The first sidewall portion 136A extends in a drawing direction in which the medicine feeder storing units 112 are drawn out, and is coupled to the second split guide member 114B. The second sidewall portion 136B is opposed to the first sidewall portion 136A with a gap therebetween. The third sidewall portion 136C extends in a direction orthogonal to the drawing direction to couple one end of the first sidewall portion 136A and one end of the second sidewall portion 136B. The fourth sidewall portion 136D extends in a direction orthogonal to the drawing direction to couple the other end of the first sidewall portion 136A and the other end of the second sidewall portion 136B. The first sidewall portion 136A is coupled to the second opposed wall 114Ba of the second split guide member 114B by appropriate connecting means such as welding. In the embodiment, the second sidewall portion 136B of the frame member 136 serves as a removable fall prevention member for the temporary storage structure 132. In other words, the fall prevention member, which prevents medicines in the storage portion 134 from falling down when the second split guide member is drawn out of the housing, defines at least a part of the second sidewall portion 136B.

As illustrated in FIG. 7, the second sidewall portion 136B of the frame member 136 is removably mounted to the end portions of the second and third sidewall portions 136C and 136D utilizing a removable attachment structure such as an attracting member such as a magnet, a retaining member such as a surface fastener, and a latching member such as a hook.

A through hole 137 is formed in the upper right corner of each of the third and fourth sidewall portions 136C and 136D. The internal space of the hollow frame member 136 defines a part of the medicine falling path. The open-close mechanism 135 (see FIG. 7B) is constituted from a shutter plate 138, a turning shaft 139, an arm 140, and a coupling shaft 141. The shutter plate 138 is flat and elongated in the front-rear direction. The turning shaft 139 is elongated and coupled to the upper side of the shutter plate 138. The turning shaft 139 is turnably supported at both ends by the frame member 136 (storage portion 134). The arm 140 is fixed at one end to the turning shaft 139 to turn about the turning shaft 139 over a predetermined angular range. The coupling shaft 141 is fixed to the other end of the arm 140, and extends in parallel with the turning shaft 139. The turning shaft 139 penetrates the through holes 137. A driven link is constituted from the turning shaft 139, the arm 140, and the coupling shaft 141. Appropriate retainers are fixed to the turning shaft 139.

In the embodiment, the second split guide member 114B is provided with the temporary storage structure 132. However, it is a matter of course that the first split guide member 114A may be provided with the temporary storage structure 132. In such a case, the first sidewall portion 136A of the frame member 136 is removably attached to the third and fourth sidewall portions 136C and 136D to constitute a fall prevention member. In addition, the open-close mechanism 135 is configured such that the through holes 137 are located closer to the second sidewall portion 136B and the distal end of the shutter plate 138 abuts against the first sidewall portion 136A.

As illustrated in detail in FIG. 8, the simultaneous driving mechanism 133 can actuate the four temporary storage structures 132 at the same time to release the medicines at a time. The coupling structures configured to couple the simultaneous driving mechanism 133 and the four temporary storage structures 132 removably couple the temporary storage structures 132 to the simultaneous driving mechanism 133. Therefore, the coupling structures allow individual removal of the temporary storage structures 132, and enable open-close operation of the temporary storage structures 132 connected thereto. As illustrated in FIGS. 8A and 8B, the simultaneous driving mechanism 133 includes a guide 145, an electric rotary motor 146, a slider 147, a bias spring 148, and a motion conversion mechanism (not illustrated). The guide 145 is fixed, and extends in the left-right direction. The electric rotary motor 146 is mounted to the guide 145. The slider 147 extends in the left-right direction as with the guide 145, and is guided by the guide 145 to be able to make reciprocal motion in the left-right direction. The bias spring 148 biases the slider 147 leftward. The motion conversion mechanism is disposed between the guide 145 and the slider 147 to convert rotation of the electric rotary motor 146 into linear motion of the slider 147. When the electric rotary motor 146 is not actuated, the motion conversion mechanism (not illustrated) becomes free, and is returned to the original state by the biasing force of the bias spring 148.

Figure 8A:
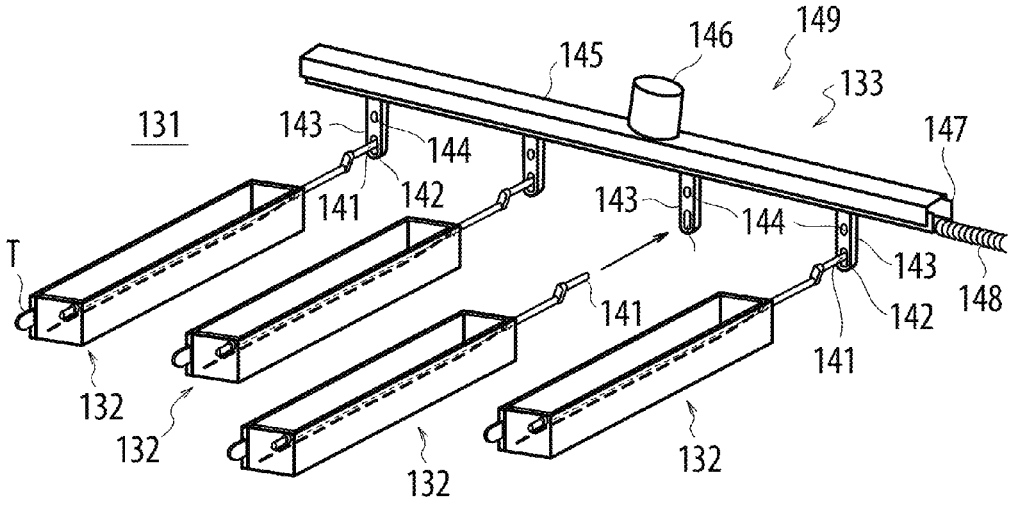
FIGS. 8A and 8B are each a perspective view of a temporary storage device.
Figure 8B:
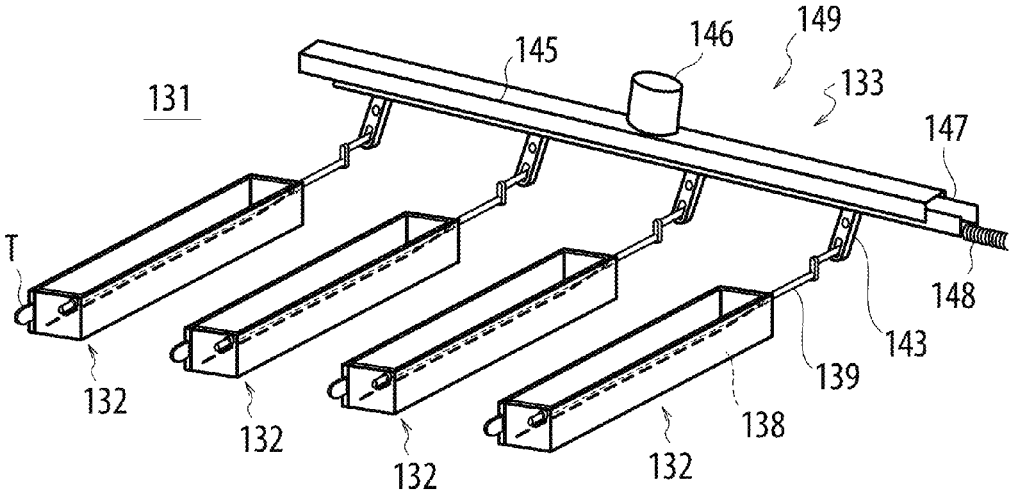

Thus, when the electric rotary motor 146 is not actuated, the slider 147 is moved to the leftmost position within its movable range by the biasing force of the bias spring 148 (see FIG. 8A). When the electric rotary motor 146 is actuated, the slider 147 makes linear motion to be moved rightward within its movable range (see FIG. 8B). After that, when operation of the electric rotary motor 146 is stopped, the slider 147 is moved again to the leftmost position within its movable range by the biasing force of the bias spring 148. A reciprocal linear motion mechanism 149 is constituted from such a structure.

The slider 147 of the reciprocal linear motion mechanism 149 is provided with a number of driving links 143, the number being the same as that of the temporary storage structures 132. The four driving links 143 are disposed side by side in the left-right direction at the same pitch as that of the temporary storage structures 132. The driving links 143 are each attached to be swingable about respective fulcrums 144 (or turnable within a predetermined angular range). For example, the upper end portion of each of the driving links 143 is attached to the slider 147 to be turnable via a turning structure (not illustrated).

An elongated fitting hole 142 is formed in a swing portion of the driving link 143, that is, the lower end portion of the driving link 143 which is opposite to the slider 147. The width of the fitting hole 142 is slightly larger than the shaft diameter of the coupling shaft 141 of the temporary storage structure 132. Therefore, if the temporary storage structure 132 is pushed into the housing, the coupling shaft 141 is inserted into the fitting hole 142 so that the coupling shaft 141 and the fitting hole 142 are fitted with each other. If the temporary storage structure 132 is drawn forward out of the housing 110A, the coupling shaft 141 is extracted from the fitting hole 142 so that the coupling shaft 141 and the fitting hole 142 are removed from each other. Thus, the driving link 143 serves as a driving-side transmission member, and the coupling shaft 141 serves as a driven-side transmission member. The two transmission members form a transmission mechanism provided at the coupling portion between the simultaneous driving mechanism 133 and the temporary storage structure 132 to releasably establish engagement therebetween.

Figure 8C:
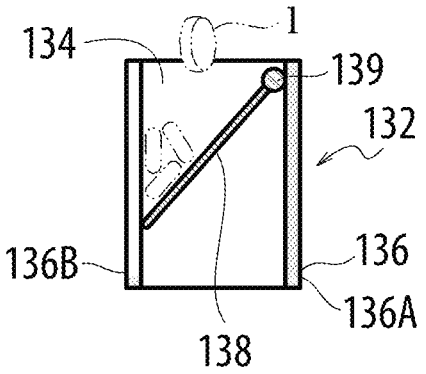
FIGS. 8C and 8D are each a vertical cross-sectional view of the temporary storage structure.
Figure 8D:
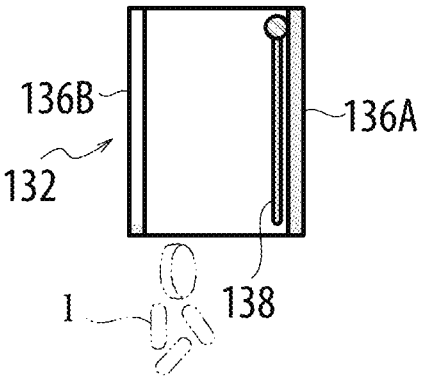
Figure 8E:
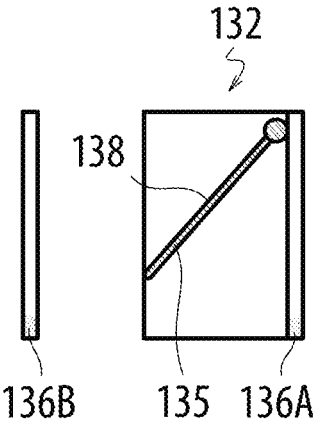
FIG. 8E is a cross-sectional view of the temporary storage structure with a fall prevention member removed.

When the electric rotary motor 146 is not actuated, as illustrated in FIG. 8C, the turning shaft 139 of the temporary storage structure 132 is turned in one direction over a predetermined angular range to bring the distal end of the shutter plate 138 into proximity to the sidewall portion 136B of the frame member 136, which brings the storage portion 134 formed above the shutter plate into the storage enabling state. When the electric rotary motor 146 is actuated, as illustrated in FIG. 8D, the turning shaft 139 is turned in the other direction over a predetermined angular range to bring the shutter plate 138 closer to the sidewall portion 136A, which brings the storage portion 134 into the releasing state. When the temporary storage structure 132 is to be cleaned, as illustrated in FIG. 8E, the second sidewall portion (fall prevention member) 136B of the frame member 136 is removed. If the second sidewall portion (fall prevention member) 136B is mounted to the third and fourth sidewall portions 136C and 136D utilizing a magnetic force of a permanent magnet or a surface fastener, the worker may hold tabs T provided at both ends of the second sidewall portion 136B in the longitudinal direction with his/her hands to apply to the tabs T a force in the direction of pulling the tabs T apart from the third and fourth sidewall portions 136C and 136D, as illustrated in FIG. 7.

The medicine collecting assembly 115 is disposed in the housing below the four temporary storage structures 132 to collect the medicines 1 dropped from the four temporary storage structures 132. The packing device 117 is provided in the housing 110A below the medicine collecting assembly 115 to separately pack the medicines discharged from the medicine collecting assembly 115.

The simultaneous driving mechanism 133 of the temporary storage device 131 does not have a medicine falling path surrounding surface. Thus, it is sufficient to clean the temporary storage structures 132 in regular cleaning work for the temporary storage device 131, with the exception of maintenance work such as disassembly and repair.

In a steady state such as during dispensing (see FIGS. 1 and 6), all the medicine feeder storing units 112 are pushed into the medicine storage 111 to be housed in the housing. Any of the medicine guide assemblies 114 can guide the falling medicines from the upper-end opening to the lower-end opening with the first split guide member 114A and the second split guide member 114B provided close and opposite to each other and with their inner opposite surfaces surrounding the medicine falling path. In addition, any of the temporary storage structures 132 surrounds the medicine falling path at the lower end portion of the corresponding medicine guide assembly 114. The simultaneous driving mechanism 133 drives the shutter plates 138 of the open-close mechanisms 135 to open and close the medicine falling path. In a closed state, the medicines (tablets) 1 discretely dropped can be temporarily stored (see FIG. 8C). When the medicine falling path is opened, the stored medicines can be released at a time (see FIG. 8D).

When the medicine guide assembly 114 and the temporary storage structure 132 are to be cleaned, the automatic dispensing operation discussed already is stopped, and the first split guide member 114A of the medicine guide assembly 114 and the second split guide member 114B of the medicine guide assembly 114 and the temporary storage structure 132 are separately cleaned. More particularly (see FIG. 2), first, only one of a pair of adjacent medicine feeder storing units 112 is drawn forward out of the medicine storage 111. If the left one of the pair of adjacent medicine feeder storing units 112 is drawn out, the first split guide member 114A forming the medicine guide assembly 114 is moved out of the housing 110A, and the entire medicine falling path surrounding surface of the first split guide member 114A is exposed to be cleaned by wiping or the like.

After that, the cleaned medicine feeder storing unit 112 is pushed back into the medicine storage 111, and the right one of the pair of adjacent medicine feeder storing units 112 is drawn forward out of the medicine storage 111. Then, the second split guide member 114B of the medicine guide assembly 114 and the temporary storage structure 132 attached thereto are moved out of the housing 110A to expose the entire medicine falling path surrounding surfaces formed by the second split guide member 114B and the temporary storage structure 132. After the medicine falling path surrounding surfaces are cleaned by wiping or the like, the cleaned medicine feeder storing unit 112 is pushed back into the medicine storage 111. If the inside of the temporary storage structure 132 is also to be cleaned at this time, the worker holds the tabs T provided at both ends of the second sidewall portion 136B in the longitudinal direction with his/her hands to apply to the tabs T a force in the direction of pulling the tabs T apart from the third and fourth sidewall portions 136C and 136D to remove the second sidewall portion 136B. Then, the inside of the frame member 136, the shutter plate 138, and the second sidewall portion 136B are cleaned. In this way, all the medicine falling path surrounding surfaces of the medicine guide assembly 114 and the temporary storage structure 132 can be cleaned. In addition, the medicine falling path surrounding surfaces can be comfortably cleaned in a standing posture as if wiping a window from inside.

Figure 9A:
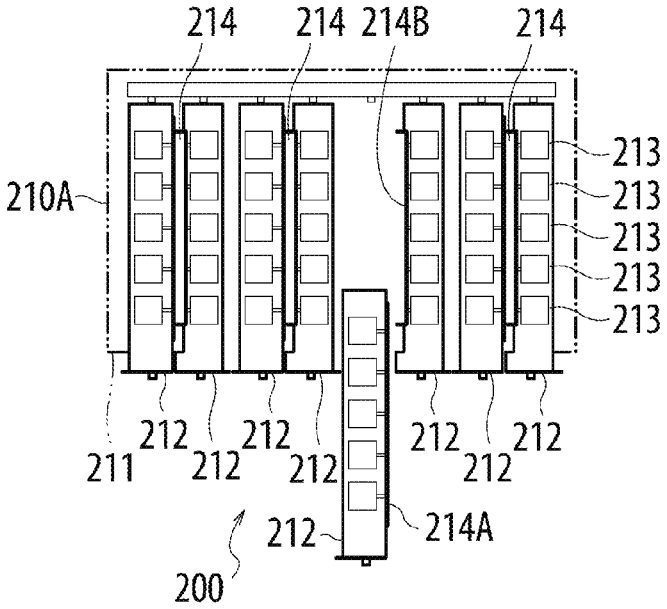
FIGS. 9A and 9B are a plan view illustrating the structure of an essential portion of a medicine dispensing apparatus according to a second embodiment of the present invention.
Figure 9B:
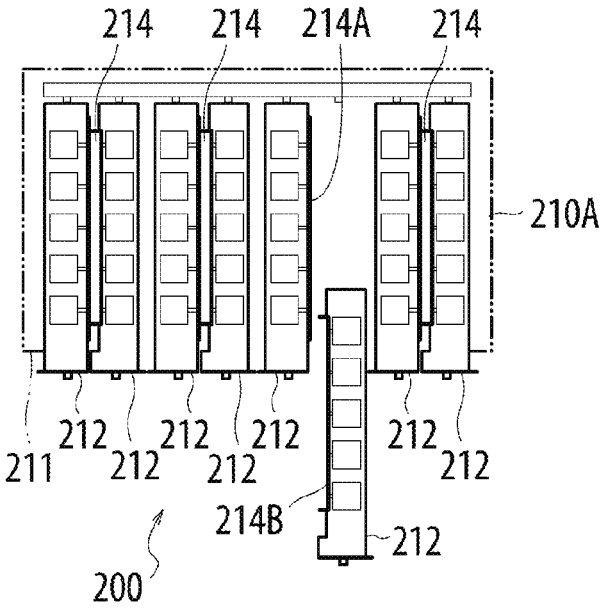
Figure 10A:
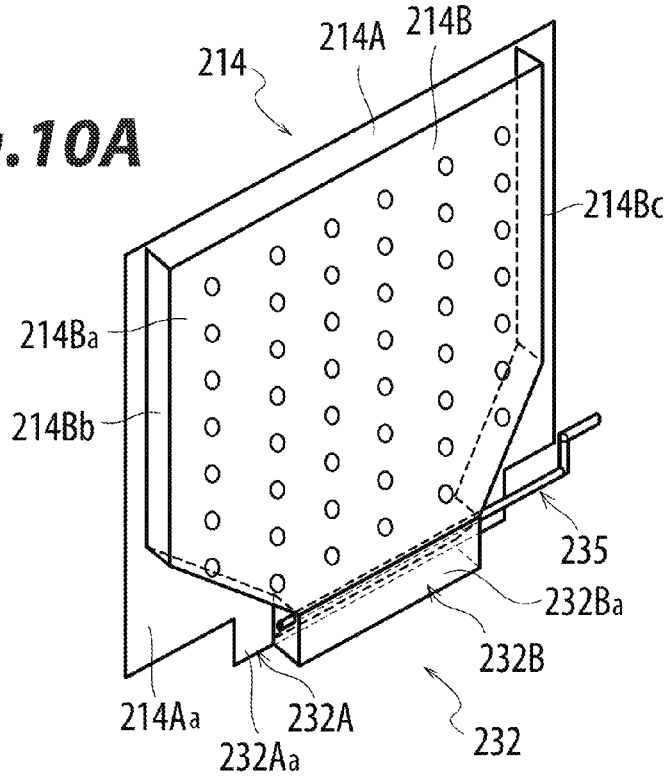
FIG. 10A is a perspective view of a medicine guide assembly and a temporary storage structure as seen from the right and obliquely above.
Figure 10B:
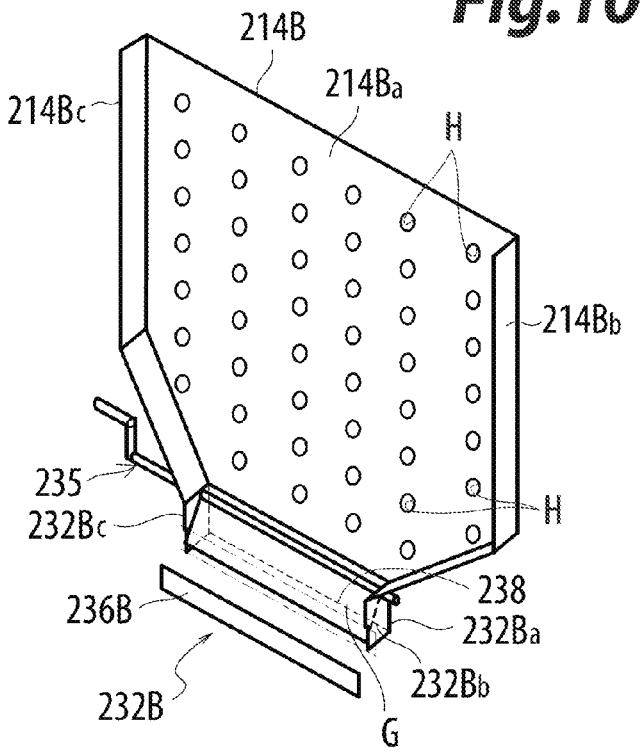
FIG. 10B is a perspective view of a second split guide member and a second split storage member as seen from the left and obliquely above.

FIGS. 9 and 10 illustrate an essential portion of a medicine dispensing apparatus 200 according to a second embodiment of the present invention. Component parts similar to those in the first embodiment illustrated in FIGS. 1 to 8 are denoted by reference numerals obtained by adding 100 to the reference numerals affixed to their counterparts in FIGS. 1 to 8 to omit descriptions. FIG. 9A is a plan view of a medicine guide assembly 214 etc. with a medicine feeder storing unit 212 located on the left side drawn forward out of a housing 210A. FIG. 9B is a plan view of the medicine feeder storing unit 214 etc. with a medicine feeder storing unit 212 located on the right side drawn forward out of the housing 210A. FIG. 10A is a perspective view of a medicine guide assembly 214 constituted from a first split guide member 214A and a second split guide member 214B and a temporary storage structure 232 constituted from a first split storage member 232A and a second split storage member 232B as seen from the right and obliquely above. FIG. 10B is a perspective view of an assembly constituted from the second split guide member 214B of the medicine guide assembly 214 and the second split storage member 232B of the temporary storage structure 232 as seen from the left and obliquely above.

The medicine dispensing apparatus 210 is different from the medicine dispensing apparatus 110 according to the first embodiment discussed above in that the integral temporary storage structure 132 is replaced with the first split storage member 232A and the second split storage member 232B, and in that the linear guide mechanism is not specifically illustrated. The temporary storage structures 232 are each constituted from first and second split storage members 232A and 232B that are combined with each other when the pair of adjacent medicine feeder storing units 212 are housed in the housing 210A and that are separated from each other when one of the pair of medicine feeder storing units 212 is drawn out of the housing 210A. A first extended opposed wall 232Aa constituting the first split storage member 232A of the temporary storage structure 232 is integrally coupled to (disposed at) the first split guide member 214A of the medicine guide assembly 214. The second split storage member 232B of the temporary storage structure 232 serves as a portion including an open-close mechanism 235, and is coupled to the second split guide member 214B of the medicine guide assembly 214. In addition, the second split storage member 232B includes a second extended opposed wall 232Ba, a first extended sidewall 232Bb, and a second extended sidewall 232Bc . The second extended opposed wall 232Ba is integrally formed with a second opposed wall 214Ba of the second split guide member 214B. The first extended sidewall 232Bb extends along a first edge portion of the second extended opposed wall 232Ba, which is located in a drawing direction in which the medicine feeder storing units 212 are drawn out, and extends in a direction away from the second extended opposed wall 232Ba to be continuous with a first sidewall 214Bb of the second split guide member 214B. The second extended sidewall 232Bc extends along a second edge portion of the second extended opposed wall 232Ba, which is located in the direction opposite to the drawing direction, and extends in a direction away from the second extended opposed wall 232Ba to be continuous with a second sidewall 214Bc of the second split guide member 214B.

In the embodiment, even if the second split storage member 232B is separated from the first split storage member 232A, a plate 236B constituting a fall prevention member is removably attached to extend between the first extended sidewall 232Bb and the second extended sidewall 232Bc. The plate 236B is attached by removable attachment means such as a permanent magnet or a surface fastener to partially block a side opening portion of the second split storage member 232B. The height of the plate 236B is smaller than the height of the first extended sidewall 232Bb and the second extended sidewall 232Bc, and a gap G is formed above the plate 236B when the plate 236B is attached. The gap G defines a medicine visual recognition portion that enables the worker to easily visually recognize that the medicines remain inside the storage portion. Even if such a gap G is formed, the side opening portion of the second split storage member 232B is completely blocked by the first extended opposed wall 232Aa of the first split storage member 232A when separate packing is performed, thereby causing no particular problem. In addition, the plate 236B functions as a stopper configured to restrict the swing range of a shutter plate 238 such that the shutter plate 238 does not go out beyond the first and second extended sidewalls 232Bb and 232Bc.

In this case, if only one of the two adjacent medicine feeder storing units 212 is drawn forward out of the housing 210A, one of the first split guide member 214A and the second split guide member 214B of the medicine guide assembly 214 is moved out of the housing 210A, and in accompaniment therewith, one of the first split storage member 232A combined with the first split guide member 214A and the second split storage member 232B combined with the second split guide member 214B is also moved out of the housing 210A. Thus, the medicine falling path surrounding surfaces of the first split guide member 214A and the first split storage member 232A, and the medicine falling path surrounding surfaces of the second split guide member 214B and the second split storage member 232B, can be cleaned by wiping or the like at the same time. In addition, if the plate 236B serving as the fall prevention member is removed, the inside of the second split storage member 232B can also be cleaned. The cleaning work can be performed in a standing posture as comfortably as wiping of a window from inside, thereby allowing the wiping or the like to be performed easily and immediately with the worker facing the surface to be cleaned.

Figure 11A:
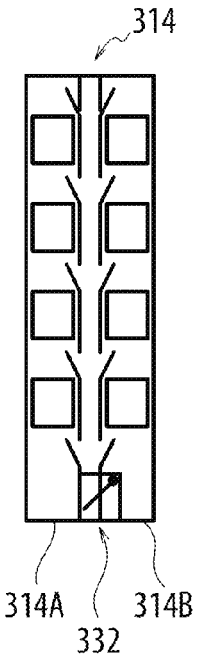
FIGS. 11A and 11B are each a schematic view illustrating the internal structure.
Figure 11B:
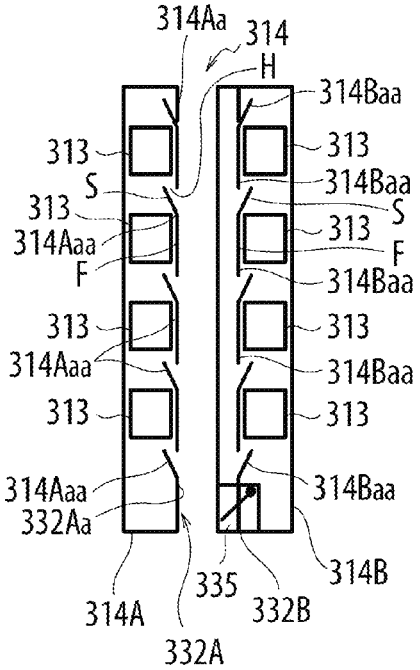
Figure 11C:
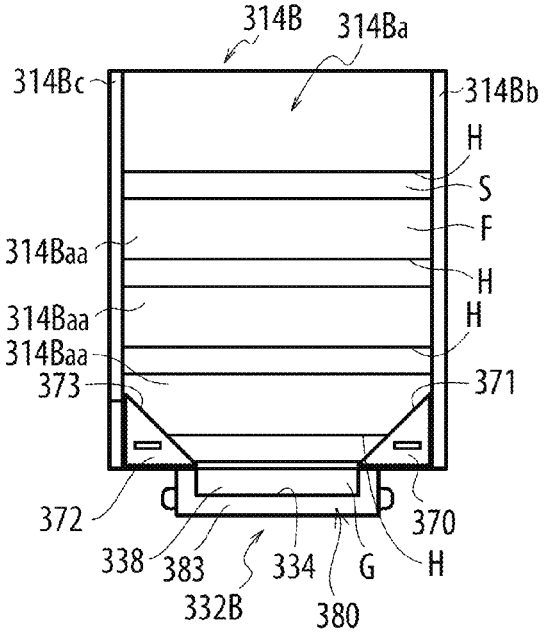
FIG. 11C is a left side view of a second split guide member of the medicine guide assembly.
Figure 11D:
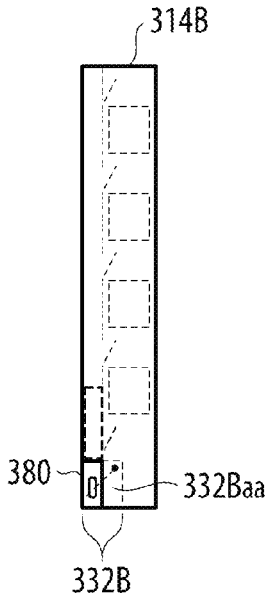
FIGS. 11D and 11E are each a front view of the second split guide member of the medicine guide assembly.
Figure 11E:
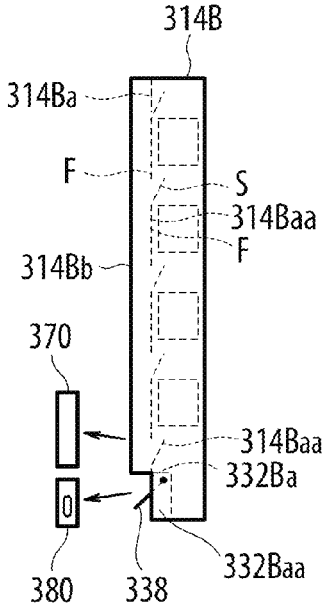
Figure 11F:
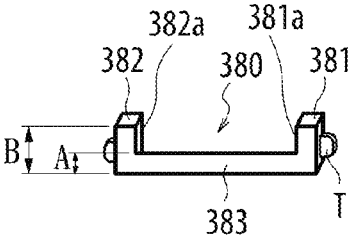
FIGS. 11F and 11G are each a perspective view of a fall prevention member.
Figure 11G:
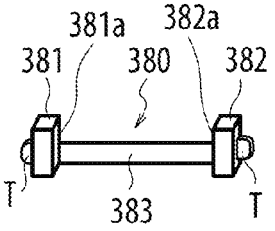
Figure 11H:
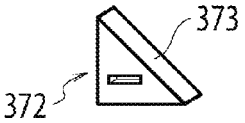
FIG. 11H is a perspective view of a second guide member.
Figure 12A:
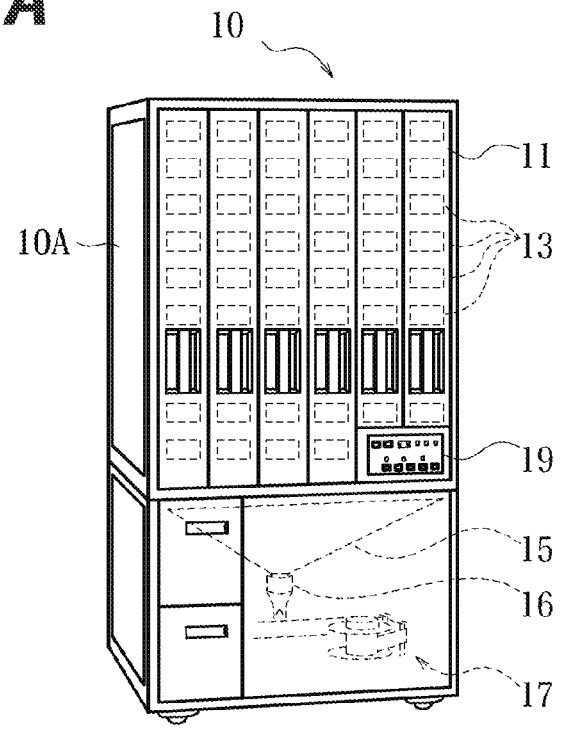
FIG. 12A is a perspective view illustrating the appearance of the medicine dispensing apparatus as seen from the left front.
Figure 12B:
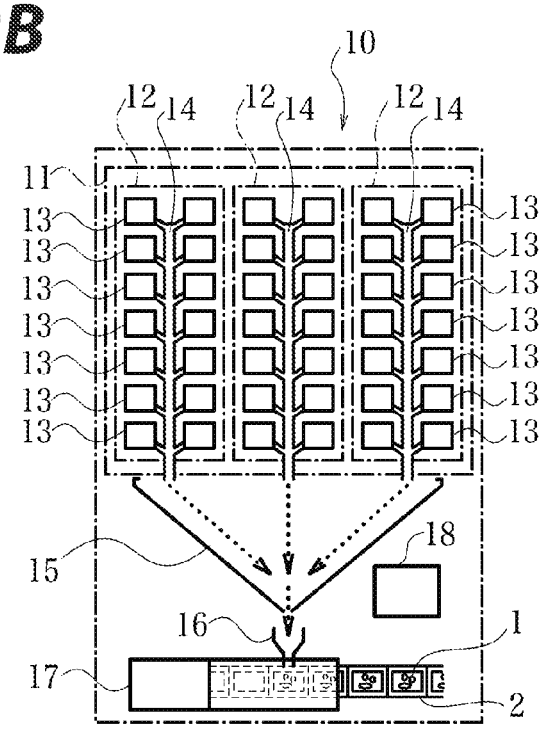
FIG. 12B is a schematic view illustrating the internal structure of the medicine dispensing apparatus.
Figure 12C:
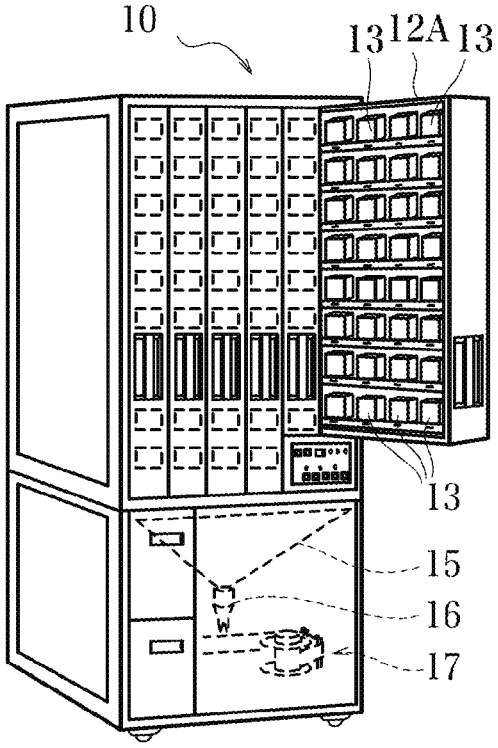
FIG. 12C is a perspective view illustrating the appearance of the medicine dispensing apparatus as seen from the left front.
Figure 12D:
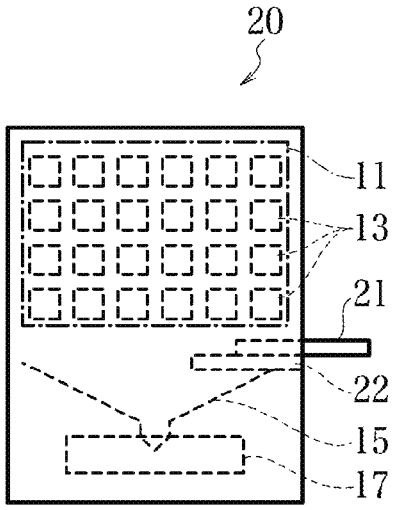
FIG. 12D is a left side view of a medicine dispensing apparatus with a manual medicine dispenser.

FIGS. 11A and 11B are each a schematic view illustrating the internal structure of a medicine guide assembly 314 and a temporary storage structure 332 used in a medicine dispensing apparatus according to a third embodiment of the present invention. FIG. 11A illustrates a mount state in which a first split guide member 314A and a second split guide member 314B of the medicine guide assembly 314 closely contact each other. FIG. 11B illustrates a developed state in which the first and second split guide members 314A and 314B are separated from each other in the left-right direction. In FIG. 11, reference numerals obtained by adding 200 to the reference numerals used in the first embodiment illustrated in FIG. 3 are used. FIG. 11C is a left side view of the second split guide member 314B of the medicine guide assembly 314. FIGS. 11D and 11E are each a front view of the second split guide member 314B of the medicine guide assembly 314. FIG. 11D illustrates a state in which a fall prevention member 380 and first and second guide members 370 and 372 are mounted. FIG. 11E illustrates a state in which the fall prevention member 380 and the first and second guide members 370 and 372 are removed. FIG. 11F is a perspective view of the outer surface side of the fall prevention member 380. FIG. 11G is a perspective view of the inner surface side or the medicine falling path surrounding surface side of the fall prevention member 380. FIG. 11H is a perspective view of the first guide member 370.

The medicine dispensing apparatus according to the third embodiment is obtained by further improving the medicine guide assemblies 214 and the temporary storage structures 232 of the medicine dispensing apparatus according to the second embodiment discussed above in order to further enhance the practicality.

Specifically, a first opposed wall 314Aa of the first split guide member 314A and a second opposed wall 314Ba of the second split guide member 314B are each configured to prevent the medicines 1 discharged from the elongated communication holes H leading to medicine discharge ports of medicine feeders 313 to the medicine falling path from jumping into lower communications holes while falling down along the medicine falling path. Specifically, the first opposed wall 314Aa is constituted by arranging a plurality of split opposed walls 314Aaa in the vertical direction, the split opposed walls 314Aaa each including an inclined surface S configured to guide the medicines dispensed from the medicine feeders 313 and a vertical surface F that extends in the vertical direction to be continuous with the inclined surface S, and the second opposed wall 314Ba is constituted by arranging a plurality of split opposed walls 314Baa in the vertical direction.

The vertical surface F of the lowermost split opposed wall 314Aaa of the first split guide member 314A according to the embodiment constitutes a first split storage member 332A. The second split guide member 314B includes the second opposed wall 314Ba, a first sidewall 314Bb, a second sidewall 314Bc, the first guide member 370, and the second guide member 372. The first sidewall 314Bb extends along a first edge portion of the second opposed wall 314Ba, which is located in a drawing direction in which the medicine feeder storing units are drawn out, and extends in a direction away from the second opposed wall 314Ba. The second sidewall 314Bc extends along a second edge portion of the second opposed wall 314Ba, which is located in the direction opposite to the drawing direction, and extends in a direction away from the second opposed wall 314Ba. The first guide member 370 is removable, and includes a first inclination surface 371 that is continuous with an inner wall surface of the first sidewall 314Bb and inclined to be closer to the second sidewall 314Bc. The second guide member 372 is removable, and includes a second inclination surface 373 that is continuous with an inner wall surface of the second sidewall 314Bc and inclined to be closer to the first sidewall 314Bb.

The first split storage member 332A includes a first extended opposed wall 332Aa coupled to the first opposed wall 314Aa of the first split guide member 314A (extended from the first opposed wall 314Aa). A second split storage member 332B is disposed at the second split guide member 314B as a portion including an open-close mechanism 335. The second split storage member 332B includes a second extended opposed wall 332Ba and the fall prevention member 380. The second extended opposed wall 332Ba is continuous with the second opposed wall 314Ba of the second split guide member 314B. The fall prevention member 380 is removably disposed at the second extended opposed wall 332Ba. In the embodiment, the lowermost split opposed wall 314Baa includes the second extended opposed wall 332Ba unlike the other split opposed walls. The second extended opposed wall 332Ba integrally includes attachment walls 332Baa at both ends in the drawing direction.

The fall prevention member 380 includes a first attachment portion 381, a second attachment portion 382, and a bridging portion 383. The first attachment portion 381 includes a first extended surface 381*a* that is continuous with the first inclination surface 371 of the first guide member 370 to extend downward when the fall prevention member 380 is attached to the attachment wall 332Baa of the second extended opposed wall 332Ba. The second attachment portion 382 includes a second extended surface 382*a* that is continuous with the second inclination surface 373 of the second guide member 372 to extend downward when the fall prevention member 380 is attached to the attachment wall 332Baa of the second extended opposed wall. The bridging portion 383 is disposed to oppose the second extended opposed wall 332Ba and extend over the first attachment portion 381 and the second attachment portion 382, and disposed to form a gap G defining a medicine visual recognition portion that enables the worker to visually recognize that the medicines remain inside the storage portion 334. In order to secure a holding force when mounted, the height B of the first and second attachment portions 381 and 382 at both ends of the fall prevention member 380 is the same as the height of the second extended opposed wall 332Ba of the temporary storage structure 332. Moreover, the height A of the middle portion, which occupies most of the overall width, is smaller than the height of the other members of the temporary storage structure 332 to the extent that the function of preventing the medicines from falling down when the first and second split guide members are drawn out is not impaired. This facilitates visually checking the inside of the second split storage member 332B of the temporary storage structure 332 even without removing the fall prevention member 380.

With such a configuration, the second split guide member 314B and the second opposed wall 314Ba and the second extended opposed wall 332Ba of the second split storage member 332B disposed at the second split guide member 314B are entirely exposed by removing the first and second guide members 370 and 372 and removing the fall prevention member 380, which advantageously facilitates cleaning work. In addition, the configuration also allows checking whether the medicines are stored in the storage portion 334 before removing the fall prevention member 380, which prevents the medicines from unnecessarily falling down. The oblique surfaces of the first and second guide members 370 and 372 facing obliquely upward are soiled with stubborn stains from the tablets, and are difficult to clean. If the removable first and second guide members are used as in the embodiment, however, the oblique surfaces can be cleaned when the first and second guide members are removed, which lessens the difficulty of cleaning.

The first and second guide members 370 and 372 and the fall prevention member 380 are preferably attached to the second split storage member 332B using a removable attachment structure such as a magnet, a surface fastener, and a retaining structure. Use of such an attachment structure allows the first and second guide members 370 and 372 and the fall prevention member 380 to be attached and removed without using a special tool.

The first and second guide members 370 and 372 are formed as a thick plate or a box in the shape of a right triangle as viewed from a side, for example. The medicines 1 falling down strongly hit the inclined surfaces 371 and 373 of the first and second guide members 370 and 372, respectively. Thus, if the base material is metal such as stainless steel, the surface of the base material is coated with polyethylene fluoride, for example, to alleviate an impact and prevent adhesion of dust.

If the medicine guide assemblies 314 and the temporary storage structures 332 are fabricated by processing a stainless steel plate, for example, the materials of the contacting portions are both metal. When components made of metal of the same quality are rubbed against each other when such components are drawn out, an unusual sound may be generated, or the surfaces may be damaged. Thus, at least one of the contacting surfaces is coated with polyethylene fluoride or the like to make the materials of the contact surfaces different from each other.

In this case, basic usage and operation and, further, cleaning work for the first split guide members 314A of the medicine guide assemblies 314 and the temporary storage structures 332 are the same as those according to the second embodiment illustrated in FIG. 9, and thus are not described to avoid repetition. Also for the second split guide member 314B, cleaning work for the greater portion of the second split guide member 314B, excluding portions to which the first and second guide members 370 and 372 are mounted, is the same as that discussed above, and thus is not described. Herein, cleaning work for the first and second guide members 370 and 372 and cleaning work for portions of the second split guide member 314B to which the first and second guide members 370 and 372 are mounted are described. The first and second guide members 370 and 372, which are removable, can be easily removed. The guide members 370 and 372 once removed can be treated in a desired posture. Thus, the inclined surfaces 371 and 373 facing obliquely upward and the other surfaces can be cleaned in a confronting manner which facilitates work. In addition, after the first and second guide members 370 and 372 are removed, not only the medicine falling path surrounding surfaces but also portions of the second split guide member 314B to which the first and second guide members 370 and 372 are mounted are exposed. Thus, cleaning work for the portions to which the first and second guide members 370 and 372 are mounted can also be performed in a confronting state.

In the first embodiment described above, the lock mechanism 160 is implemented as a combination of mechanical components only. However, the lock mechanism 160 may be implemented as a combination of mechanical components, an electronic control circuit, and so forth. What combination to adopt may be determined in consideration of the importance of maintaining functionality during a power failure, ease of maintenance and modification, and further a cost reduction.

A further modification is preferably made such that the coupling shaft 141 is smoothly inserted into the fitting hole 142 when the temporary storage structure 132 which has been disengaged from the simultaneous driving mechanism 133 becomes engaged therewith, although not illustrated or described in the first embodiment described above. For example, the distal end of the coupling shaft 141 may be pointed by tapering the distal end of the coupling shaft 141. For example, the medicine dispensing apparatus may be provided with biasing means such as a weak spring to force the temporary storage structure 132 into a closed state to keep the coupling shaft 141 suitable for engagement if there is no external force. The movable range and the stop position of the drive link 143 and the coupling shaft 141 may be individually determined in an individually adjustable manner.

In the embodiments described above, a manual medicine dispensing device is disposed below the temporary storage structures as in the related art. However, the manual medicine dispensing device may be disposed above the temporary storage structures. For example, the lowermost medicine feeder may be omitted and a manual medicine dispensing device may be provided instead in any of the medicine feeder storing units. This allows the manual medicine dispensing device to be provided above the temporary storage structures, and to be drawn out in accompaniment with the medicine feeder storing unit, which facilitates cleaning, repair, and so forth of the manual medicine dispensing device.

In the third embodiment described above, a plurality of split opposed walls 314Aaa and 314Baa are disposed in a multiplicity of rows for a single plate formed with a multiplicity of communication holes leading to the medicine discharge ports of the medicine feeders and disposed in a vertical and horizontal arrangement as a specific example of the first split guide member 314A and the second split guide member 314B of the medicine guide assembly 314. However, the plurality of split opposed walls 314Aaa and 314Baa illustrated in FIG. 11 may be held by front and rear frames or the like to constitute the first split guide member 314A and the second split guide member 314B. In this case, communication holes leading to the medicine discharge ports of the medicine feeders are in the form of horizontally elongated slits.

In addition, the present invention may also be applied to a medicine dispensing apparatus without a manual medicine dispensing device.

INDUSTRIAL APPLICABILITY

Use of a fall prevention member as in the present invention not only prevents medicines from falling down during cleaning, but also facilitates cleaning work for medicine feeder storing units including temporary storage structures. In addition, use of linear guide mechanisms as in the present invention makes it possible to reduce rubbing between respective opposed surfaces of a pair of medicine feeder storing units compared to a case where a pair of medicine feeder storing units are drawn out of and pushed into a housing in parallel with each other.

DESCRIPTION OF REFERENCE NUMERALS

1 medicine
10 medicine dispensing apparatus
12 medicine feeder storing unit
30 medicine dispensing apparatus
110 medicine dispensing apparatus
110A housing
111 medicine storage
112 medicine feeder storing unit
113 medicine feeder
114 medicine guide assembly
114A first split guide member
114B second split guide member
115 medicine collecting assembly
117 packing device
118 controller
119 operation panel
131 temporary storage device
132 temporary storage structure
133 simultaneous driving mechanism
134 storage portion
135 open-close mechanism
136 frame member
138 shutter plate
139 turning shaft
140 arm
141 coupling shaft
142 fitting hole
143 driving link
146 electric rotary motor
147 slider
148 bias spring
149 reciprocal linear motion mechanism
150 linear guide mechanism
θ opening angle

The invention claimed is:

1. A medicine dispensing apparatus comprising:

a housing;

a plurality of medicine feeder storing units arranged side by side inside the housing such that the medicine feeder storing units can be drawn out of the housing and each including a plurality of medicine feeders configured to store medicines to sequentially discharge the medicines, and a medicine feeder storing case configured to house the plurality of medicine feeders;

a plurality of linear guide mechanisms configured to guide the plurality of medicine feeder storing units to linearly move;

a plurality of medicine guide assemblies each disposed between a pair of adjacent medicine feeder storing units among the plurality of medicine feeder storing units and configured to guide the medicines discharged from the plurality of medicine feeders included in the pair of medicine feeder storing units to an exit port located downward a plurality of temporary storage structures each including a storage portion configured to temporarily store the medicines dropped from the plurality of medicine guide assemblies and an open-close mechanism configured to bring the storage portion into a storage enabling state, upon application of a closing drive force, to allow storage of the dropped medicines and to bring the storage portion into a releasing state, upon application of an opening drive force, to discharge the medicines downward from the storage portion, the plurality of temporary storage structures being each provided such that the entirety of each temporary storage structure or a portion of each temporary storage structure including the open-close mechanism is drawable out of the housing;

a simultaneous driving mechanism configured to simultaneously apply the closing drive force or the opening drive force to the open-close mechanisms of the plurality of temporary storage structures;

a medicine collecting assembly disposed in the housing below the plurality of temporary storage structures to collect the medicines dropped from the plurality of temporary storage structures;

a packing device provided in the housing below the medicine collecting assembly to separately pack the medicines discharged from the medicine collecting assembly; and a plurality of coupling structures configured to couple the simultaneous driving mechanism and the open-close mechanisms of the plurality of temporary storage structures, the coupling structures being each configured to release the coupling when the medicine feeder storing unit is drawn out of the housing to draw the entirety of each temporary storage structure or the portion of each temporary storage structure including the open-close mechanism out of the housing, and to establish the coupling when the medicine feeder storing unit is pushed into the housing to push the entirety of each temporary storage structure or the portion of each temporary storage structure including the open-close mechanism into the housing, wherein:

the medicine guide assemblies are each constituted from first and second split guide members that are combined with each other when the pair of medicine feeder storing units are housed in the housing and that are separated from each other when one of the pair of medicine feeder storing units is drawn out of the housing;

the first split guide member is fixed to the medicine feeder storing case of one of the pair of medicine feeder storing units, and the second split guide member is fixed to the medicine feeder storing case of the other of the pair of medicine feeder storing units;

the entirety of each of the temporary storage structures is disposed at one of the first and second split guide members, or a part of each of the temporary storage structures is disposed at one of the first and second split guide members and the remainder of each of the temporary storage structures is disposed at the other of the first and second split guide members;

the temporary storage structures each further include a fall prevention member configured to prevent the medicines in the storage portion from falling down when one of the first and second split guide members is drawn out of the housing;

the fall prevention member is removable, and located to enable an inside of the storage portion to be cleaned when the fall prevention member is removed; and the plurality of linear guide mechanisms are configured such that a gap between a pair of guide paths of a pair of the linear guide mechanisms configured to guide the pair of medicine feeder storing units becomes wider in a drawing direction in which the medicine feeder storing units are drawn out.

2. A medicine dispensing apparatus comprising:

a housing;

a plurality of medicine feeder storing units arranged side by side inside the housing such that the medicine feeder storing units can be drawn out of the housing and each including a plurality of medicine feeders configured to store medicines to sequentially discharge the medicines, and a medicine feeder storing case configured to house the plurality of medicine feeders;

a plurality of linear guide mechanisms configured to guide the plurality of medicine feeder storing units to linearly move;

a plurality of medicine guide assemblies each disposed between a pair of adjacent medicine feeder storing units among the plurality of medicine feeder storing units and configured to guide the medicines discharged from the plurality of medicine feeders included in the pair of medicine feeder storing units to an exit port located downward;

a medicine collecting assembly disposed in the housing below the medicine guide assemblies to collect the medicines dropped from the medicine guide assemblies; and a packing device provided in the housing below the medicine collecting assembly to separately pack the medicines discharged from the medicine collecting assembly, wherein:

the medicine guide assemblies are each constituted from first and second split guide members that are combined with each other when the pair of medicine feeder storing units are housed in the housing and that are separated from each other when one of the pair of medicine feeder storing units is drawn out of the housing;

the first split guide member is fixed to the medicine feeder storing case of one of the pair of medicine feeder storing units, and the second split guide member is fixed to the medicine feeder storing case of the other of the pair of medicine feeder storing units; and the plurality of linear guide mechanisms are configured such that a gap between a pair of guide paths of a pair of the linear guide mechanisms configured to guide the pair of medicine feeder storing units becomes wider in a drawing direction in which the medicine feeder storing units are drawn out.

3. The medicine dispensing apparatus according to claim 2, further comprising:

a lock mechanism that, when one of the pair of medicine feeder storing units is drawn out, is operable to prevent drawing out a medicine feeder storing unit that is adjacent to the one of the pair of medicine feeder storing units but that does not constitute the pair of medicine feeder storing units.

4. The medicine dispensing apparatus according to claim 2, further comprising:

a lock mechanism that, when one of the pair of medicine feeder storing units is drawn out, is operable to prevent drawing out any of the medicine feeder storing units other than the one of the pair of medicine feeder storing unit.

5. The medicine dispensing apparatus according to claim 2, further comprising:

a plurality of temporary storage structures each including a storage portion configured to temporarily store the medicines dropped from the plurality of medicine guide assemblies and an open-close mechanism configured to bring the storage portion into a storage enabling state, upon application of a closing drive force, to allow storage of the dropped medicines and to bring the storage portion into a releasing state, upon application of an opening drive force, to discharge the medicines downward from the storage portion, the plurality of temporary storage structures being each provided such that the entirety of each temporary storage structure or a portion of each temporary storage structure including the open-close mechanism is drawable out of the housing;

a simultaneous driving mechanism configured to simultaneously apply the closing drive force or the opening drive force to the open-close mechanisms of the plurality of temporary storage structures; and a plurality of coupling structures configured to couple the simultaneous driving mechanism and the open-close mechanisms of the plurality of temporary storage structures, the coupling structures being each configured to release the coupling when the medicine feeder storing unit is drawn out of the housing to draw the entirety of each temporary storage structure or the portion of each temporary storage structure including the open-close mechanism out of the housing, and to establish the coupling when the medicine feeder storing unit is pushed into the housing to push the entirety of each temporary storage structure or the portion of each temporary storage structure including the open-close mechanism into the housing, wherein:

the medicine collecting assembly is disposed below the plurality of temporary storage structures;

the entirety of each of the temporary storage structures is disposed at one of the first and second split guide members, or a part of each of the temporary storage structures is disposed at one of the first and second split guide members and the remainder of each of the temporary storage structures is disposed at the other of the first and second split guide members;

the temporary storage structures each further include a fall prevention member configured to prevent the medicines in the storage portion from falling down when one of the first and second split guide members is drawn out of the housing; and the fall prevention member is located to enable an inside of the storage portion to be cleaned when the fall prevention member is removed.

6. The medicine dispensing apparatus according to claim 5, wherein:

the temporary storage structures are each constructed by combining a thin and long frame member having an upper-end opening portion and a lower-end opening portion and the open-close mechanism;

the frame member includes a first sidewall portion extending in a drawing direction in which the medicine feeder storing units are drawn out and coupled to one of the first and second split guide members, a second sidewall portion opposed to the first sidewall portion with a gap therebetween, a third sidewall portion extending in a direction orthogonal to the drawing direction to couple one end of the first sidewall portion and one end of the second sidewall portion, and a fourth sidewall portion extending in a direction orthogonal to the drawing direction to couple the other end of the first sidewall portion and the other end of the second sidewall portion;

the fall prevention member defines at least a part of the second sidewall portion; and the open-close mechanism defines the storage portion together with the second sidewall portion when the open-close mechanism is closed.

7. The medicine dispensing apparatus according to claim 5, wherein:

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism; and the fall prevention member is disposed at the second split storage member.

8. The medicine dispensing apparatus according to claim 5, wherein:

the first split guide member includes a first opposed wall formed with a plurality of discharge holes to allow passage of the medicines discharged from the plurality of medicine feeders included in the one of the medicine feeder storing units;

the second split guide member includes a second opposed wall formed with a plurality of discharge holes to allow passage of the medicines discharged from the plurality of medicine feeders included in the other of the medicine feeder storing units, a first sidewall extending along a first edge portion of the second opposed wall, which is located in a drawing direction in which the medicine feeder storing units are drawn out, and extending in a direction away from the second opposed wall, and a second sidewall extending along a second edge portion of the second opposed wall, which is located in the direction opposite to the drawing direction, and extending in a direction away from the second opposed wall;

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism;

the first split storage member includes a first extended opposed wall coupled to the first opposed wall of the first split guide member;

the second split storage member includes a second extended opposed wall that is continuous with the second opposed wall of the second split guide member, a first extended sidewall extending along a first edge portion of the second extended opposed wall, which is located in the drawing direction, and extending in a direction away from the second extended opposed wall to be continuous with the first sidewall, and a second extended sidewall extending along a second edge portion of the second extended opposed wall, which is located in the direction opposite to the drawing direction, and extending in a direction away from the second extended opposed wall to be continuous with the second sidewall; and the fall prevention member is disposed to oppose the second extended opposed wall and extend over the first extended sidewall and the second extended sidewall, and sized and shaped to define a medicine visual recognition portion that enables a worker to visually recognize that the medicines remain inside the storage portion.

9. The medicine dispensing apparatus according to claim 8, wherein the fall prevention member is attached to the temporary storage structure using a removable attachment structure.

10. The medicine dispensing apparatus according to claim 5, wherein:

the first split guide member includes a first opposed wall formed with a plurality of discharge holes to allow passage of the medicines discharged from the plurality of medicine feeders included in the one of the medicine feeder storing units;

the second split guide member includes a second opposed wall formed with a plurality of discharge holes to allow passage of the medicines discharged from the plurality of medicine feeders included in the other of the medicine feeder storing units, a first sidewall extending along a first edge portion of the second opposed wall, which is located in a drawing direction in which the medicine feeder storing units are drawn out, and extending in a direction away from the second opposed wall, a second sidewall extending along a second edge portion of the second opposed wall, which is located in the direction opposite to the drawing direction, and extending in a direction away from the second opposed wall, a removable first guide member including a first inclination surface that is continuous with an inner wall surface of the first sidewall and inclined to be closer to the second sidewall, and a removable second guide member including a second inclination surface that is continuous with an inner wall surface of the second sidewall and inclined to be closer to the first sidewall;

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism;

the first split storage member includes a first extended opposed wall coupled to the first opposed wall of the first split guide member;

the second split storage member includes a second extended opposed wall that is continuous with the second opposed wall of the second split guide member, and the fall prevention member removably disposed at the second extended opposed wall; and the fall prevention member includes a first attachment portion including a first extended surface that is continuous with the first inclination surface to extend downward when the fall prevention member is attached to the second extended opposed wall, a second attachment portion including a second extended surface that is continuous with the second inclination surface to extend downward when the fall prevention member is attached to the second extended opposed wall, and a bridging portion disposed to oppose the second extended opposed wall and extend over the first attachment portion and the second attachment portion, and disposed to define a medicine visual recognition portion that enables a worker to visually recognize that the medicines remain inside the storage portion.

11. The medicine dispensing apparatus according to claim 10, wherein the fall prevention member is attached to the temporary storage structure using a removable attachment structure.

12. The medicine dispensing apparatus according to claim 5, wherein the fall prevention member is attached to the temporary storage structure using a removable attachment structure.

13. A medicine dispensing apparatus comprising:

a housing;

a plurality of medicine feeder storing units arranged side by side inside the housing such that the medicine feeder storing units can be drawn out of the housing and each including a plurality of medicine feeders configured to store medicines to sequentially discharge the medicines, and a medicine feeder storing case configured to house the plurality of medicine feeders;

a plurality of medicine guide assemblies each disposed between a pair of adjacent medicine feeder storing units among the plurality of medicine feeder storing units and configured to guide the medicines discharged from the plurality of medicine feeders included in the pair of medicine feeder storing units to an exit port located downward;

a plurality of temporary storage structures each including a storage portion configured to temporarily store the medicines dropped from the plurality of medicine guide assemblies and an open-close mechanism configured to bring the storage portion into a storage enabling state, upon application of a closing drive force, to allow storage of the dropped medicines and to bring the storage portion into a releasing state, upon application of an opening drive force, to discharge the medicines downward from the storage portion upon, the plurality of temporary storage structures being each provided such that the entirety of each temporary storage structure or a portion of each temporary storage structure including the open-close mechanism is drawable out of the housing;

a simultaneous driving mechanism configured to simultaneously apply the closing drive force or the opening drive force to the open-close mechanisms of the plurality of temporary storage structures;

a medicine collecting assembly disposed in the housing below the plurality of temporary storage structures to collect the medicines dropped from the plurality of temporary storage structures;

a packing device provided in the housing below the medicine collecting assembly to separately pack the medicines discharged from the medicine collecting assembly; and a plurality of coupling structures configured to couple the simultaneous driving mechanism and the open-close mechanisms of the plurality of temporary storage structures, the coupling structures being each configured to release the coupling when the medicine feeder storing unit is drawn out of the housing to draw the entirety of each temporary storage structure or the portion of each temporary storage structure including the open-close mechanism out of the housing, and to establish the coupling when the medicine feeder storing unit is pushed into the housing to push the entirety of each temporary storage structure or the portion of each temporary storage structure including the open-close mechanism into the housing, wherein:

the medicine guide assemblies are each constituted from first and second split guide members that are combined with each other when the pair of medicine feeder storing units are housed in the housing and that are separated from each other when one of the pair of medicine feeder storing units is drawn out of the housing;

the first split guide member is fixed to the medicine feeder storing case of one of the pair of medicine feeder storing units, and the second split guide member is fixed to the medicine feeder storing case of the other of the pair of medicine feeder storing units;

the entirety of each of the temporary storage structures is disposed at one of the first and second split guide members, or a part of each of the temporary storage structures is disposed at one of the first and second split guide members and the remainder of each of the temporary storage structures is disposed at the other of the first and second split guide members;

the temporary storage structures each further include a fall prevention member configured to prevent the medicines in the storage portion from falling down when one of the first and second split guide members is drawn out of the housing; and the fall prevention member is located to enable an inside of the storage portion to be cleaned when the fall prevention member is removed.

14. The medicine dispensing apparatus according to claim 13, wherein:

the temporary storage structures are each constructed by combining a thin and long frame member having an upper-end opening portion and a lower-end opening portion and the open-close mechanism;

the frame member includes a first sidewall portion extending in a drawing direction in which the medicine feeder storing units are drawn out and coupled to one of the first and second split guide members, a second sidewall portion opposed to the first sidewall portion with a gap therebetween, a third sidewall portion extending in a direction orthogonal to the drawing direction to couple one end of the first sidewall portion and one end of the second sidewall portion, and a fourth sidewall portion extending in a direction orthogonal to the drawing direction to couple the other end of the first sidewall portion and the other end of the second sidewall portion;

the fall prevention member defines at least a part of the second sidewall portion; and the open-close mechanism defines the storage portion together with the second sidewall portion when the open-close mechanism is closed.

15. The medicine dispensing apparatus according to claim 13, wherein:

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism; and the fall prevention member is disposed at the second split storage member.

16. The medicine dispensing apparatus according to claim 13, wherein:

the first split guide member includes a first opposed wall formed with a plurality of discharge holes to allow passage of the medicines discharged from the plurality of medicine feeders included in the one of the medicine feeder storing units;

the second split guide member includes a second opposed wall formed with a plurality of discharge holes to allow passage of the medicines discharged from the plurality of medicine feeders included in the other of the medicine feeder storing units, a first sidewall extending along a first edge portion of the second opposed wall, which is located in a drawing direction in which the medicine feeder storing units are drawn out, and extending in a direction away from the second opposed wall, and a second sidewall extending along a second edge portion of the second opposed wall, which is located in the direction opposite to the drawing direction, and extending in a direction away from the second opposed wall;

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism;

the first split storage member includes a first extended opposed wall coupled to the first opposed wall of the first split guide member;

the second split storage member includes a second extended opposed wall that is continuous with the second opposed wall of the second split guide member, a first extended sidewall extending along a first edge portion of the second extended opposed wall, which is located in the drawing direction, and extending in a direction away from the second extended opposed wall to be continuous with the first sidewall, and a second extended sidewall extending along a second edge portion of the second extended opposed wall, which is located in the direction opposite to the drawing direction, and extending in a direction away from the second extended opposed wall to be continuous with the second sidewall; and the fall prevention member is disposed to oppose the second extended opposed wall and extend over the first extended sidewall and the second extended sidewall, and sized and shaped to define a medicine visual recognition portion that enables a worker to visually recognize that the medicines remain inside the storage portion.

17. The medicine dispensing apparatus according to claim 13, wherein:

the first split guide member includes a first opposed wall formed with a plurality of discharge holes to allow passage of the medicines discharged from the plurality of medicine feeders included in the one of the medicine feeder storing units;

the second split guide member includes a second opposed wall formed with a plurality of discharge holes to allow passage of the medicines discharged from the plurality of medicine feeders included in the other of the medicine feeder storing units, a first sidewall extending along a first edge portion of the second opposed wall, which is located in a drawing direction in which the medicine feeder storing units are drawn out, and extending in a direction away from the second opposed wall, a second sidewall extending along a second edge portion of the second opposed wall, which is located in the direction opposite to the drawing direction, and extending in a direction away from the second opposed wall, a removable first guide member including a first inclination surface that is continuous with an inner wall surface of the first sidewall and inclined to be closer to the second sidewall, and a removable second guide member including a second inclination surface that is continuous with an inner wall surface of the second sidewall and inclined to be closer to the first sidewall;

the temporary storage structures are each constituted from first and second split storage members that are combined with each other when the pair of medicine feeder storing units are housed in the housing and that are separated from each other when one of the pair of medicine feeder storing units is drawn out of the housing;

the first split storage member of the temporary storage structure is disposed at the first split guide member of the medicine guide assembly, and the second split storage member of the temporary storage structure is disposed at the second split guide member of the medicine guide assembly as the portion of the temporary storage structure including the open-close mechanism;

the first split storage member includes a first extended opposed wall coupled to the first opposed wall of the first split guide member;

the second split storage member includes a second extended opposed wall that is continuous with the second opposed wall of the second split guide member, and the fall prevention member removably disposed at the second extended opposed wall; and the fall prevention member includes a first attachment portion including a first extended surface that is continuous with the first inclination surface to extend downward when the fall prevention member is attached to the second extended opposed wall, a second attachment portion including a second extended surface that is continuous with the second inclination surface to extend downward when the fall prevention member is attached to the second extended opposed wall, and a bridging portion disposed to oppose the second extended opposed wall and extend over the first attachment portion and the second attachment portion, and disposed to define a medicine visual recognition portion that enables a worker to visually recognize that the medicines remain inside the storage portion.

18. The medicine dispensing apparatus according to claim 13, wherein the fall prevention member is attached to the temporary storage structure using a removable attachment structure.

* * * * *